US010255754B2

(12) United States Patent
Bell

(10) Patent No.: US 10,255,754 B2
(45) Date of Patent: Apr. 9, 2019

(54) METHODS AND SYSTEMS FOR INTERACTIVE IMAGE SHARING

(71) Applicant: Puzzup LLC, Santa Fe, NM (US)

(72) Inventor: Cayley Michael Bell, Santa Fe, NM (US)

(73) Assignee: Puzzup LLC, Santa Fe, NM (US)

( * ) Notice: Subject to any disclaimer, the term of this patent is extended or adjusted under 35 U.S.C. 154(b) by 162 days.

(21) Appl. No.: 14/946,158

(22) Filed: Nov. 19, 2015

(65) Prior Publication Data

US 2016/0203577 A1 Jul. 14, 2016

Related U.S. Application Data

(60) Provisional application No. 62/102,116, filed on Jan. 12, 2015.

(51) Int. Cl.

| | |
|---|---|
| ***G07F 17/32*** | (2006.01) |
| *A63F 9/10* | (2006.01) |
| *A63F 9/06* | (2006.01) |
| *A63F 9/24* | (2006.01) |

(52) U.S. Cl.

CPC ..... *G07F 17/3223* (2013.01); *A63F 9/0612* (2013.01); *A63F 9/10* (2013.01); *A63F 2009/241* (2013.01)

(58) Field of Classification Search

CPC ..... G07F 17/3223; A63F 9/0612; A63F 2009/241

See application file for complete search history.

(56) References Cited

U.S. PATENT DOCUMENTS

| | | | | |
|---|---|---|---|---|
| 2009/0258687 | A1* | 10/2009 | Weichselbaum | A63F 9/10 463/9 |
| 2014/0189507 | A1* | 7/2014 | Valente | G06F 3/04845 715/705 |
| 2014/0289625 | A1* | 9/2014 | Mandalia | G06F 3/01 715/716 |
| 2015/0352435 | A1* | 12/2015 | Imai | A63F 13/2145 463/9 |

* cited by examiner

*Primary Examiner* — Roland J Casillas

(74) *Attorney, Agent, or Firm* — Blueshift IP, LLC; Cynthia M. Gilbert

(57) ABSTRACT

A method for interactive image sharing includes receiving, by an image sharing application executing on a first computing device, from a second computing device, a plurality of puzzle piece images and an image associated with the plurality of puzzle piece images. The method includes generating, by a puzzle generator executing on the first computing device, a puzzle assembly interface. The method includes confirming, by the puzzle generator, assembly of the plurality of puzzle piece images by a user of the first computing device. The method includes displaying, by the puzzle generator, the image associated with the plurality of puzzle piece images upon confirmation of assembly.

10 Claims, 21 Drawing Sheets

METHODS AND SYSTEMS FOR INTERACTIVE IMAGE SHARING

CROSS-REFERENCE TO RELATED APPLICATION

This application claims priority from U.S. Provisional Patent Application No. 62/102,116, filed on Jan. 12, 2015, entitled "Methods and Systems for Interactive Image Sharing," which is hereby incorporated by reference.

BACKGROUND

The disclosure relates to image sharing. More particularly, the methods and systems described herein relate to interactive image sharing.

Conventional systems for sharing images typically allow a first user of a computing device to select, edit, and transmit a digital image to a second user. Such systems, however, do not typically provide means for the second user to interact with the image, only to view the image.

BRIEF SUMMARY

In one aspect, a method for interactive image sharing includes receiving, by an image sharing application executing on a first computing device, an image and addressee information. The method includes generating, by a puzzle generator executing on the first computing device, a plurality of puzzle piece images, based on the received image. The method includes transmitting, by the image sharing application, to a second computing device, the plurality of puzzle piece images and the received image, using the received addressee information.

In another aspect, a method for interacting with a shared image includes receiving, by an image sharing application executing on a first computing device, from a second computing device, a plurality of puzzle piece images and an image associated with the plurality of puzzle piece images. The method includes generating, by a puzzle generator executing on the first computing device, a puzzle assembly interface. The method includes confirming, by the puzzle generator, assembly of the plurality of puzzle piece images by a user of the first computing device. The method includes displaying, by the puzzle generator, the image associated with the plurality of puzzle piece images upon confirmation of assembly.

In another aspect, a system for interactive image sharing includes an image sharing application (i) executing on a first computing device, (ii) receiving an image and addressee information, and (iii) transmitting a plurality of puzzle piece images and the received image to a second computing device using the received addressee information. The system includes a puzzle generator (i) executing on the first computing device and (ii) generating the plurality of puzzle piece images, based on the received image.

In another aspect, a system for interactive image sharing includes an image sharing application executing on a first computing device and receiving a plurality of puzzle piece images and an original image associated with the plurality of puzzle piece images. The system includes a puzzle generator (i) executing on the first computing device, (ii) generating a puzzle assembly interface, (iii) confirming assembly of the plurality of puzzle piece images by a user of the first computing device, and (iv) displaying the original image associated with the plurality of puzzle piece images upon confirmation of assembly.

BRIEF DESCRIPTION OF THE DRAWINGS

The foregoing and other objects, aspects, features, and advantages of the disclosure will become more apparent and better understood by referring to the following description taken in conjunction with the accompanying drawings, in which.

DETAILED DESCRIPTION

In some embodiments, the methods and systems described herein relate to interactive image sharing. Before describing such methods and systems in detail, however, a description is provided of a network in which such methods and systems may be implemented.

Figure 1A:
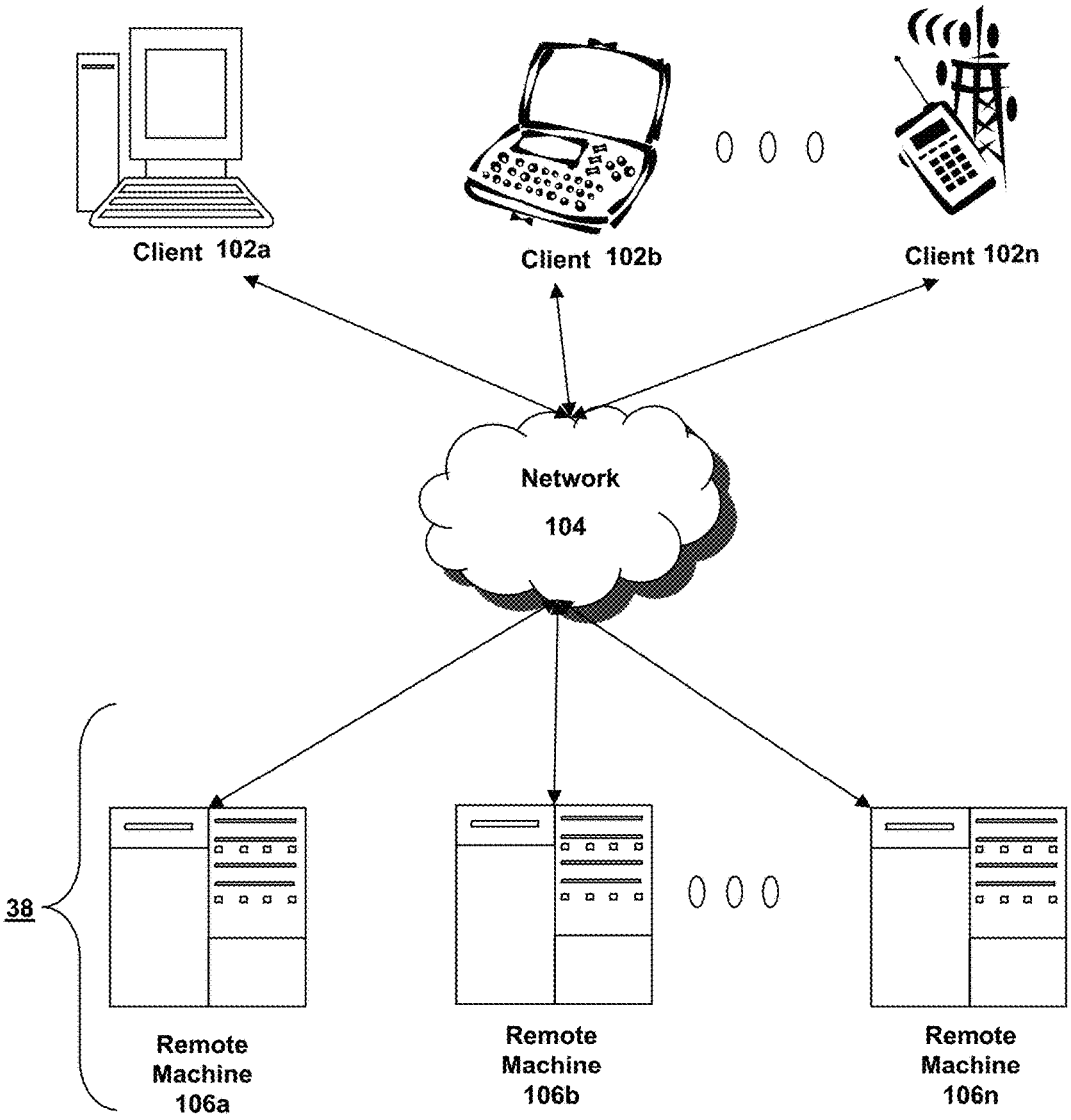
FIGS. 1A-1C are block diagrams depicting embodiments of computers useful in connection with the methods and systems described herein.

Referring now to FIG. 1A, an embodiment of a network environment is depicted. In brief overview, the network environment comprises one or more clients 102*a*-102*n* (also generally referred to as local machine(s) 102, client(s) 102, client node(s) 102, client machine(s) 102, client computer(s) 102, client device(s) 102, computing device(s) 102, endpoint(s) 102, or endpoint node(s) 102) in communication with one or more remote machines 106*a*-106*n* (also generally referred to as server(s) 106 or computing device(s) 106) via one or more networks 104.

Although FIG. 1A shows a network 104 between the clients 102 and the remote machines 106, the clients 102 and the remote machines 106 may be on the same network 104. The network 104 can be a local area network (LAN), such as a company Intranet, a metropolitan area network (MAN), or a wide area network (WAN), such as the Internet or the World Wide Web. In some embodiments, there are multiple networks 104 between the clients 102 and the remote machines 106. In one of these embodiments, a network 104' (not shown) may be a private network and a network 104 may be a public network. In another of these embodiments, a network 104 may be a private network and a network 104' a public network. In still another embodiment, networks 104 and 104' may both be private networks. In another embodiment, networks 104 and 104' may both be public networks.

The network 104 may be any type and/or form of network and may include any of the following: a point to point network, a broadcast network, a wide area network, a local area network, a telecommunications network, a data communication network, a computer network, an ATM (Asynchronous Transfer Mode) network, a SONET (Synchronous Optical Network) network, an SDH (Synchronous Digital Hierarchy) network, a wireless network, and a wireline network. In some embodiments, the network 104 may comprise a wireless link, such as an infrared channel or satellite band. The topology of the network 104 may be a bus, star, or ring network topology. The network 104 may be of any such network topology as known to those ordinarily skilled in the art capable of supporting the operations described herein. The network may comprise mobile telephone networks utilizing any protocol or protocols used to communicate among mobile devices (including tables and handheld devices generally), including AMPS, TDMA, CDMA, GSM, GPRS, UMTS, or LTE. In some embodiments, different types of data may be transmitted via different protocols. In other embodiments, the same types of data may be transmitted via different protocols.

A client 102 and a remote machine 106 (referred to generally as computing devices 100) can be any workstation, desktop computer, laptop or notebook computer, server, portable computer, mobile telephone, mobile smartphone, or other portable telecommunication device, media playing device, a gaming system, mobile computing device, or any other type and/or form of computing, telecommunications or media device that is capable of communicating on any type and form of network and that has sufficient processor power and memory capacity to perform the operations described herein.

A client 102 may execute, operate or otherwise provide an application, which can be any type and/or form of software, program, or executable instructions, including, without limitation, any type and/or form of web browser, web-based client, client-server application, an ActiveX control, or a JAVA applet, or any other type and/or form of executable instructions capable of executing on client 102.

In one embodiment, a remote machine 106 provides the functionality of a web server.

In some embodiments, the system may include multiple, logically-grouped remote machines 106. In one of these embodiments, the logical group of remote machines may be referred to as a server farm 38. In another of these embodiments, the server farm 38 may be administered as a single entity.

Figure 1B:
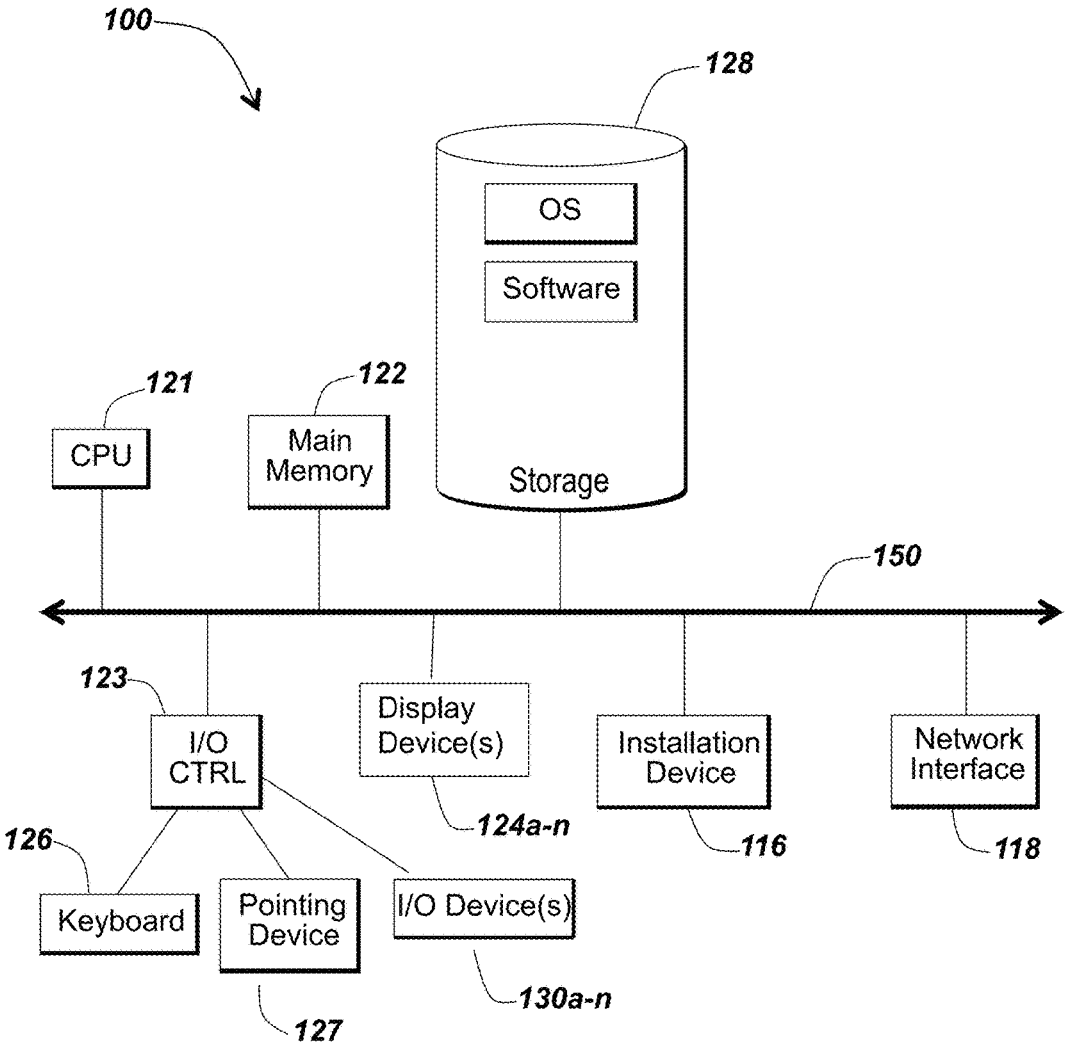
Figure 1C:
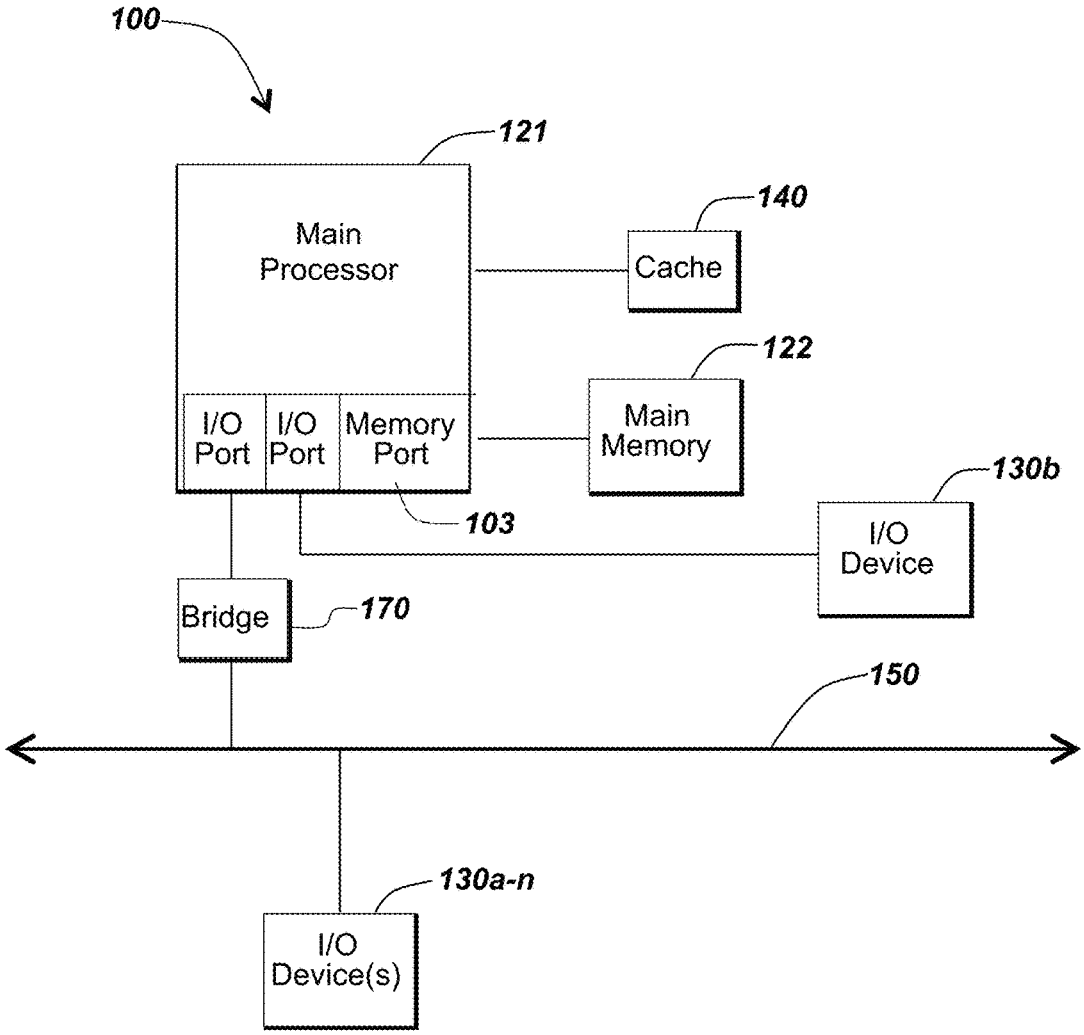

FIGS. 1B and 1C depict block diagrams of a computing device 100 useful for practicing an embodiment of the client 102 or a remote machine 106. As shown in FIGS. 1B and 1C, each computing device 100 includes a central processing unit 121, and a main memory unit 122. As shown in FIG. 1B, a computing device 100 may include a storage device 128, an installation device 116, a network interface 118, an I/O controller 123, display devices 124*a-n*, a keyboard 126, a pointing device 127, such as a mouse, and one or more other I/O devices 130*a-n*. The storage device 128 may include, without limitation, an operating system and software. As shown in FIG. 1C, each computing device 100 may also include additional optional elements, such as a memory port 103, a bridge 170, one or more input/output devices 130*a*-130*n* (generally referred to using reference numeral 130), and a cache memory 140 in communication with the central processing unit 121.

The central processing unit 121 is any logic circuitry that responds to and processes instructions fetched from the main memory unit 122. In many embodiments, the central processing unit 121 is provided by a microprocessor unit, such as: those manufactured by Intel Corporation of Mountain View, Calif.; those manufactured by Motorola Corporation of Schaumburg, Ill.; those manufactured by Transmeta Corporation of Santa Clara, Calif.; those manufactured by International Business Machines of White Plains, N.Y.; or those manufactured by Advanced Micro Devices of Sunnyvale, Calif. Other examples include SPARC processors, ARM processors, processors used to build UNIX/LINUX "white" boxes, and processors for mobile devices. The computing device 100 may be based on any of these processors, or any other processor capable of operating as described herein.

Main memory unit 122 may be one or more memory chips capable of storing data and allowing any storage location to be directly accessed by the microprocessor 121. The main memory 122 may be based on any available memory chips capable of operating as described herein. In the embodiment shown in FIG. 1B, the processor 121 communicates with main memory 122 via a system bus 150. FIG. 1C depicts an embodiment of a computing device 100 in which the processor communicates directly with main memory 122 via a memory port 103. FIG. 1C also depicts an embodiment in which the main processor 121 communicates directly with cache memory 140 via a secondary bus, sometimes referred to as a backside bus. In other embodiments, the main processor 121 communicates with cache memory 140 using the system bus 150.

In the embodiment shown in FIG. 1B, the processor 121 communicates with various I/O devices 130 via a local system bus 150. Various buses may be used to connect the central processing unit 121 to any of the I/O devices 130, including a VESA VL bus, an ISA bus, an EISA bus, a MicroChannel Architecture (MCA) bus, a PCI bus, a PCI-X bus, a PCI-Express bus, or a NuBus. For embodiments in which the I/O device is a video display 124, the processor 121 may use an Advanced Graphics Port (AGP) to communicate with the display 124. FIG. 1C depicts an embodiment of a computer 100 in which the main processor 121 also communicates directly with an I/O device 130*b* via, for example, HYPERTRANSPORT, RAPIDIO, or INFINIBAND communications technology.

A wide variety of I/O devices 130*a*-130*n* may be present in the computing device 100. Input devices include keyboards, mice, trackpads, trackballs, microphones, scanners, cameras, and drawing tablets. Output devices include video displays, speakers, inkjet printers, laser printers, and dye-sublimation printers. The I/O devices may be controlled by an I/O controller 123 as shown in FIG. 1B. Furthermore, an I/O device may also provide storage and/or an installation device 116 for the computing device 100. In some embodiments, the computing device 100 may provide USB connections (not shown) to receive handheld USB storage devices such as the USB Flash Drive line of devices manufactured by Twintech Industry, Inc. of Los Alamitos, Calif.

Referring still to FIG. 1B, the computing device 100 may support any suitable installation device 116, such as a floppy disk drive for receiving floppy disks such as 3.5-inch, 5.25-inch disks or ZIP disks; a CD-ROM drive; a CD-R/RW drive; a DVD-ROM drive; tape drives of various formats; a USB device; a hard-drive or any other device suitable for installing software and programs. In some embodiments, the computing device 100 may provide functionality for installing software over a network 104. The computing device 100 may further comprise a storage device, such as one or more hard disk drives or redundant arrays of independent disks, for storing an operating system and other software. Alternatively, the computing device 100 may rely on memory chips for storage instead of hard disks.

Furthermore, the computing device 100 may include a network interface 118 to interface to the network 104 through a variety of connections including, but not limited to, standard telephone lines, LAN or WAN links (e.g., 802.11, T1, T3, 56 kb, X.25, SNA, DECNET), broadband connections (e.g., ISDN, Frame Relay, ATM, Gigabit Ethernet, Ethernet-over-SONET), wireless connections, or some combination of any or all of the above. Connections can be established using a variety of communication protocols (e.g., TCP/IP, IPX, SPX, NetBIOS, Ethernet, ARCNET, SONET, SDH, Fiber Distributed Data Interface (FDDI), RS232, IEEE 802.11, IEEE 802.11a, IEEE 802.11b, IEEE 802.11g, IEEE 802.11n, 802.15.4, Bluetooth, ZIGBEE, CDMA, GSM, WiMax, and direct asynchronous connections). In one embodiment, the computing device 100 communicates with other computing devices 100' via any type and/or form of gateway or tunneling protocol such as Secure Socket Layer (SSL) or Transport Layer Security (TLS). The network interface 118 may comprise a built-in network adapter, network interface card, PCMCIA network card, card bus network adapter, wireless network adapter, USB network adapter, modem, or any other device suitable for interfacing the computing device 100 to any type of network capable of communication and performing the operations described herein.

In some embodiments, the computing device 100 may comprise or be connected to multiple display devices 124*a*-124*n*, which each may be of the same or different type and/or form. In further embodiments, an I/O device 130 may be a bridge between the system bus 150 and an external communication bus, such as a USB bus, an Apple Desktop Bus, an RS-232 serial connection, a SCSI bus, a FireWire bus, a FireWire 800 bus, an Ethernet bus, an AppleTalk bus, a Gigabit Ethernet bus, an Asynchronous Transfer Mode bus, a HIPPI bus, a Super HIPPI bus, a SerialPlus bus, a SCI/LAMP bus, a FibreChannel bus, or a Serial Attached small computer system interface bus.

A computing device 100 of the sort depicted in FIGS. 1B and 1C typically operates under the control of operating systems, which control scheduling of tasks and access to system resources. The computing device 100 can be running any operating system such as any of the versions of the MICROSOFT WINDOWS operating systems, the different releases of the UNIX and LINUX operating systems, any version of the MAC OS for Macintosh computers, any embedded operating system, any real-time operating system, any open source operating system, any proprietary operating system, any operating systems for mobile computing devices, or any other operating system capable of running on the computing device and performing the operations described herein. Typical operating systems include, but are not limited to: WINDOWS 3.x, WINDOWS 95, WINDOWS 98, WINDOWS 2000, WINDOWS NT 3.51, WINDOWS NT 4.0, WINDOWS CE, WINDOWS XP, WINDOWS 7, WINDOWS 8, and WINDOWS VISTA, all of which are manufactured by Microsoft Corporation of Redmond, Wash.; MAC OS manufactured by Apple Inc. of Cupertino, Calif.; OS/2 manufactured by International Business Machines of Armonk, N.Y.; LINUX, a freely-available operating system distributed by Caldera Corp. of Salt Lake City, Utah; Red Hat Enterprise Linux, a Linus-variant operating system distributed by Red Hat, Inc. of Raleigh, N.C.; Ubuntu, a freely-available operating system distributed by Canonical Ltd. of London, England; or any type and/or form of a UNIX operating system, among others.

The computing device 100 can be any workstation, desktop computer, laptop or notebook computer, server, portable computer, mobile telephone or other portable telecommunication device, media playing device, a gaming system, mobile computing device, or any other type and/or form of computing, telecommunications or media device that is capable of communication and that has sufficient processor power and memory capacity to perform the operations described herein. In some embodiments, the computing device 100 may have different processors, operating systems, and input devices consistent with the device. In other embodiments the computing device 100 is a mobile device, such as a JAVA-enabled cellular telephone/smartphone or personal digital assistant (PDA). The computing device 100 may be a mobile device such as those manufactured, by way of example and without limitation, by Apple Inc. of Cupertino, Calif.; Google/Motorola Div. of Ft. Worth, Tex.; Kyocera of Kyoto, Japan; Samsung Electronics Co., Ltd. of Seoul, Korea; Nokia of Finland; Hewlett-Packard Development Company, L.P. and/or Palm, Inc. of Sunnyvale, Calif.; Sony Ericsson Mobile Communications AB of Lund, Sweden; or Research In Motion Limited of Waterloo, Ontario, Canada. In yet other embodiments, the computing device 100 is a smartphone, Pocket PC, Pocket PC Phone, or other portable mobile device supporting Microsoft Windows Mobile Software.

In some embodiments, the computing device 100 is a digital audio player. In one of these embodiments, the computing device 100 is a digital audio player such as the Apple IPOD, IPOD Touch, IPOD NANO, and IPOD SHUFFLE lines of devices manufactured by Apple Inc. In another of these embodiments, the digital audio player may function as both a portable media player and as a mass storage device. In other embodiments, the computing device 100 is a digital audio player such as those manufactured by, for example, and without limitation, Samsung Electronics America of Ridgefield Park, N.J., or Creative Technologies Ltd. of Singapore. In yet other embodiments, the computing device 100 is a portable media player or digital audio player supporting file formats including, but not limited to, MP3, WAV, M4A/AAC, WMA Protected AAC, AEFF, Audible audiobook, Apple Lossless audio file formats, and .mov, .m4v, and .mp4 MPEG-4 (H.264/MPEG-4 AVC) video file formats.

In some embodiments, the computing device 100 comprises a combination of devices, such as a mobile phone combined with a digital audio player or portable media player. In one of these embodiments, the computing device 100 is a device in the Google/Motorola line of combination digital audio players and mobile phones. In another of these embodiments, the computing device 100 is a device in the IPHONE smartphone line of devices manufactured by Apple Inc. In still another of these embodiments, the computing device 100 is a device executing the ANDROID open source mobile phone platform distributed by the Open Handset Alliance; for example, the computing device 100 may be a device such as those provided by Samsung Electronics of Seoul, Korea, or HTC Headquarters of Taiwan, R.O.C. In other embodiments, the computing device 100 is a tablet device such as, for example and without limitation, the IPAD line of devices manufactured by Apple Inc.; the PLAYBOOK manufactured by Research In Motion; the CRUZ line of devices manufactured by Velocity Micro, Inc. of Richmond, Va.; the FOLIO and THRIVE line of devices manufactured by Toshiba America Information Systems, Inc. of Irvine, Calif.; the GALAXY line of devices manufactured by Samsung; the HP SLATE line of devices manufactured by Hewlett-Packard; and the STREAK line of devices manufactured by Dell, Inc. of Round Rock, Tex.

In some embodiments, the methods and systems described herein provide functionality for interactive image sharing. In some of these embodiments, the methods and systems described herein allow a sending user to transmit to a receiving user an image that the receiving user can manipulate, modify, and otherwise interact with. In one of these embodiments, the methods and systems described herein allow a sending user to share an image in a way that engages the receiving user, making the experience more participatory for the recipient of the image. In another of these embodiments, the methods and systems described herein provide functionality to "gamify" the experience of photo-sharing by incorporating puzzle-solving interfaces into image sharing applications; in some embodiments, this results in increased user entertainment and engagement. In still another of these embodiments, the methods and systems described herein create an interactive, receiver-based experience, in contrast to conventional image sharing applications where images are transmitted to a passive audience.

Figure 2A:
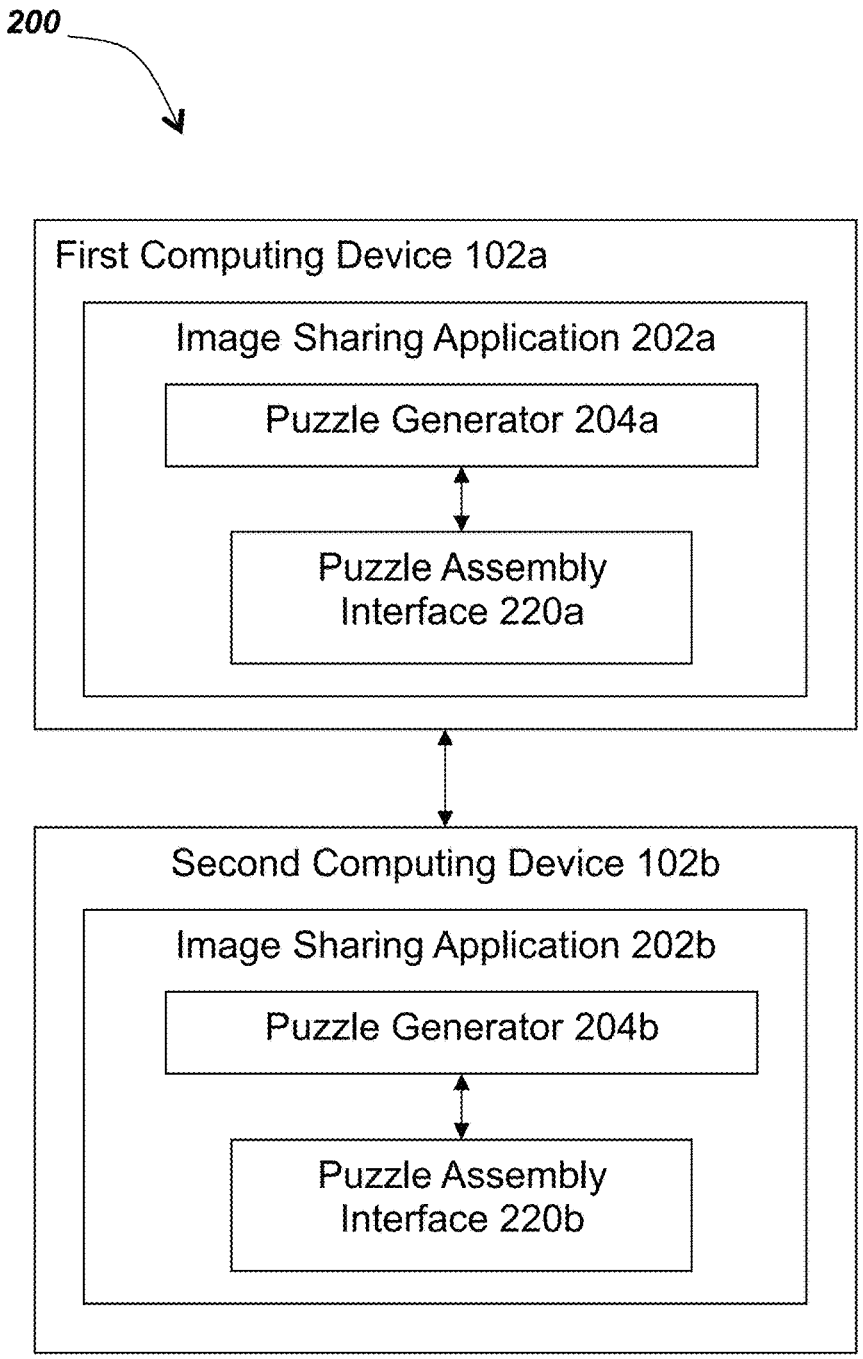
FIG. 2A is a block diagram depicting one embodiment of a system for interactive image sharing.

Referring now to FIG. 2A, a block diagram depicts one embodiment of a system 200 for interactive image sharing. In brief overview, the system 200 includes a first computing device 102*a* and a second computing device 102*b* (which may be referred to generally as computing devices 102). The computing devices 102 may be computing devices 102 as described above in connection with FIGS. 1A-1C. The system 200 includes an image sharing application 202*a*, a puzzle generator 204*a*, and a puzzle assembly interface 220*a* executing on the first computing device 102*a*. The system 200 includes an image sharing application 202*b*, a puzzle generator 204*b*, and a puzzle assembly interface 220*b* executing on the second computing device 102*b*.

In one embodiment, the image sharing application 202*a* includes functionality allowing a user of the first computing device to select an image for sharing as a set of puzzle pieces to be assembled in order to view the shared image. In another embodiment, the image sharing application 202*a* includes functionality allowing a user to specify details associated with the puzzle and the recipient (e.g., specifying a level of difficulty of the puzzle and providing addressee information associated with the recipient of the puzzle). In still another embodiment, the image sharing application 202*a* includes functionality allowing a user to track a status or level of completion of one or more shared puzzles. In some embodiments, the image sharing application 202*a* includes a user interface allowing a recipient of a plurality of puzzle piece images to request a display of each of the plurality of puzzle piece images at different locations within the user interface, emulating the experience of recombining the separate puzzle piece images into a single image—this may be referred to herein as allowing a user to "assemble" the puzzle piece images or "complete" the puzzle.

In one embodiment, the image sharing application 202*a* executes on the first computing device 102*a*. In another embodiment, the image sharing application 202*a* may be a software program. In still another embodiment, the image sharing application 202*a* may be a hardware module. In another embodiment, the image sharing application 202*a* is in communication with the puzzle generator 204*a*. In yet another embodiment, the image sharing application 202*a* provides the functionality of the puzzle generator 204*a*. The image sharing application 202*a* may receive an image and addressee information and transmit a plurality of puzzle piece images and the received image to a second computing device 102*b* using the received addressee information.

In one embodiment, the puzzle generator 204*a* executes on the first computing device 102*a*. In another embodiment, the puzzle generator 204*a* may be a software program. In still another embodiment, the puzzle generator 204*a* may be a hardware module. In another embodiment, the puzzle generator 204*a* is in communication with the image sharing application 202*a*. In yet another embodiment, the puzzle generator 204*a* provides the functionality of the image sharing application 202*a*. The puzzle generator 204*a* may generate the plurality of puzzle piece images, based on the received image.

Figure 2B:
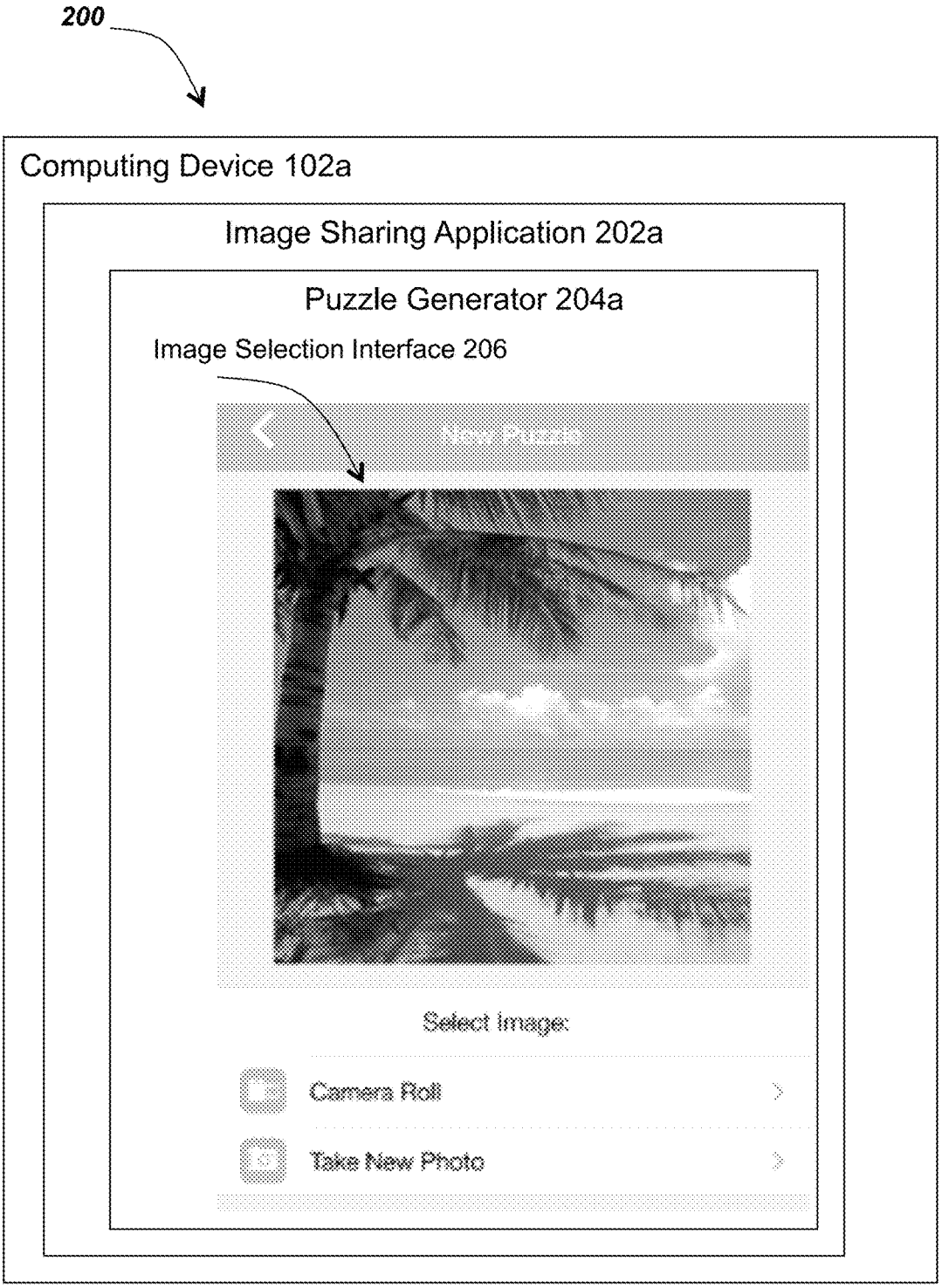
FIG. 2B is a block diagram depicting one embodiment of a system for interactive image sharing including an image selection interface.

Referring now to FIG. 2B, a block diagram depicts one embodiment of a system 200 for interactive image sharing including an image selection interface 206. In some embodiments, as will be discussed in greater detail below, a user of the system 200 accesses the image selection interface 206 to select an image for sharing. In one embodiment, the image sharing application 202*a* includes functionality for generating the image selection interface 206. As shown in FIG. 2B, the image selection interface 206 may provide interfaces allowing a user to indicate whether the image sharing application 202*a* should select an image from a plurality of images stored on the computing device 102*a* (referred to in FIG. 2B as the "camera roll") or to use a camera on the computing device 102*a* to generate a new image. Although depicted as a square image in FIG. 2B, the selected image may be any format and is not restricted to squares.

Figure 2C:
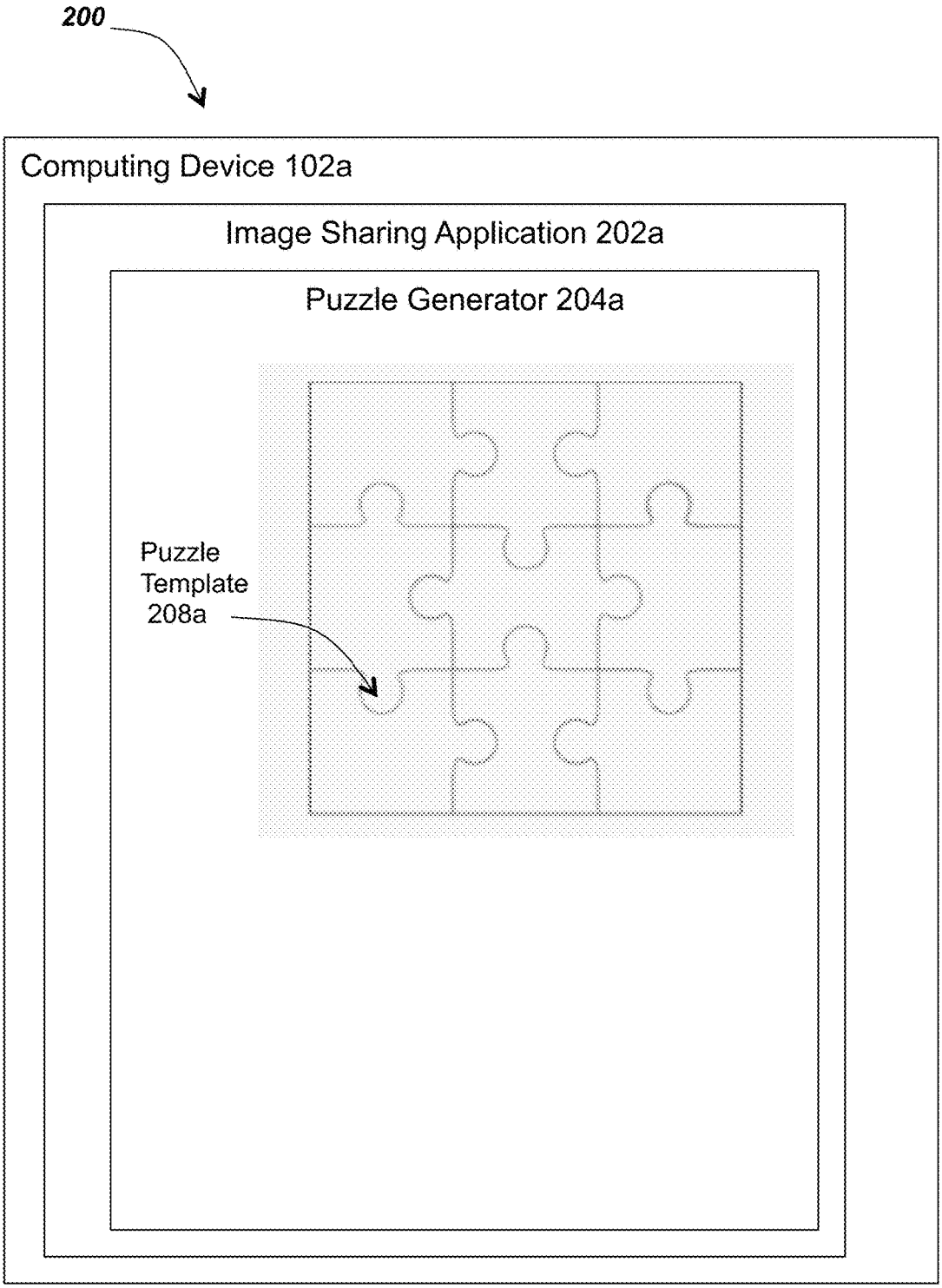
FIGS. 2C-2E are block diagrams depicting embodiments of puzzle templates in a system for interactive image sharing.
Figure 2D:
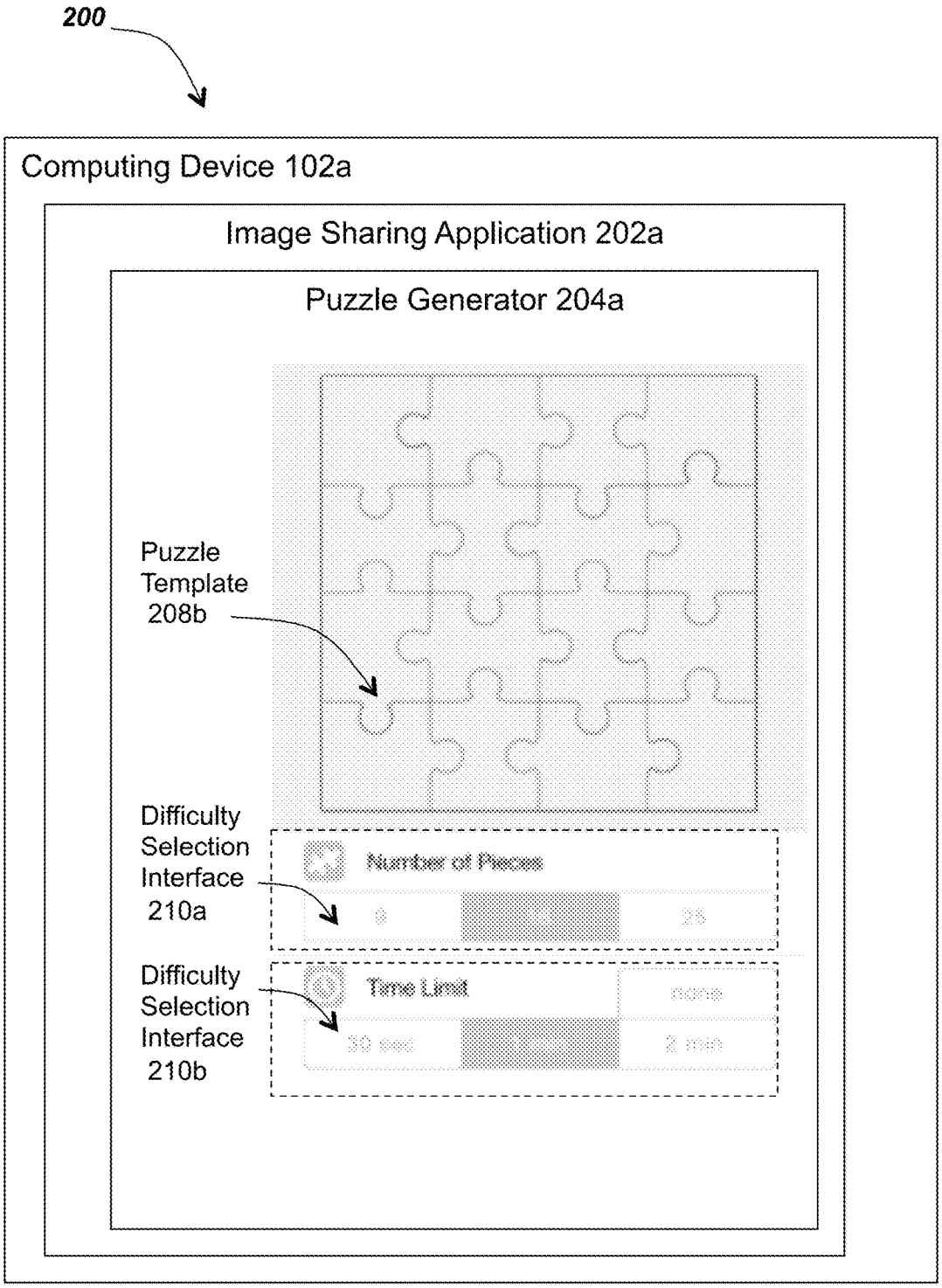
Figure 2E:
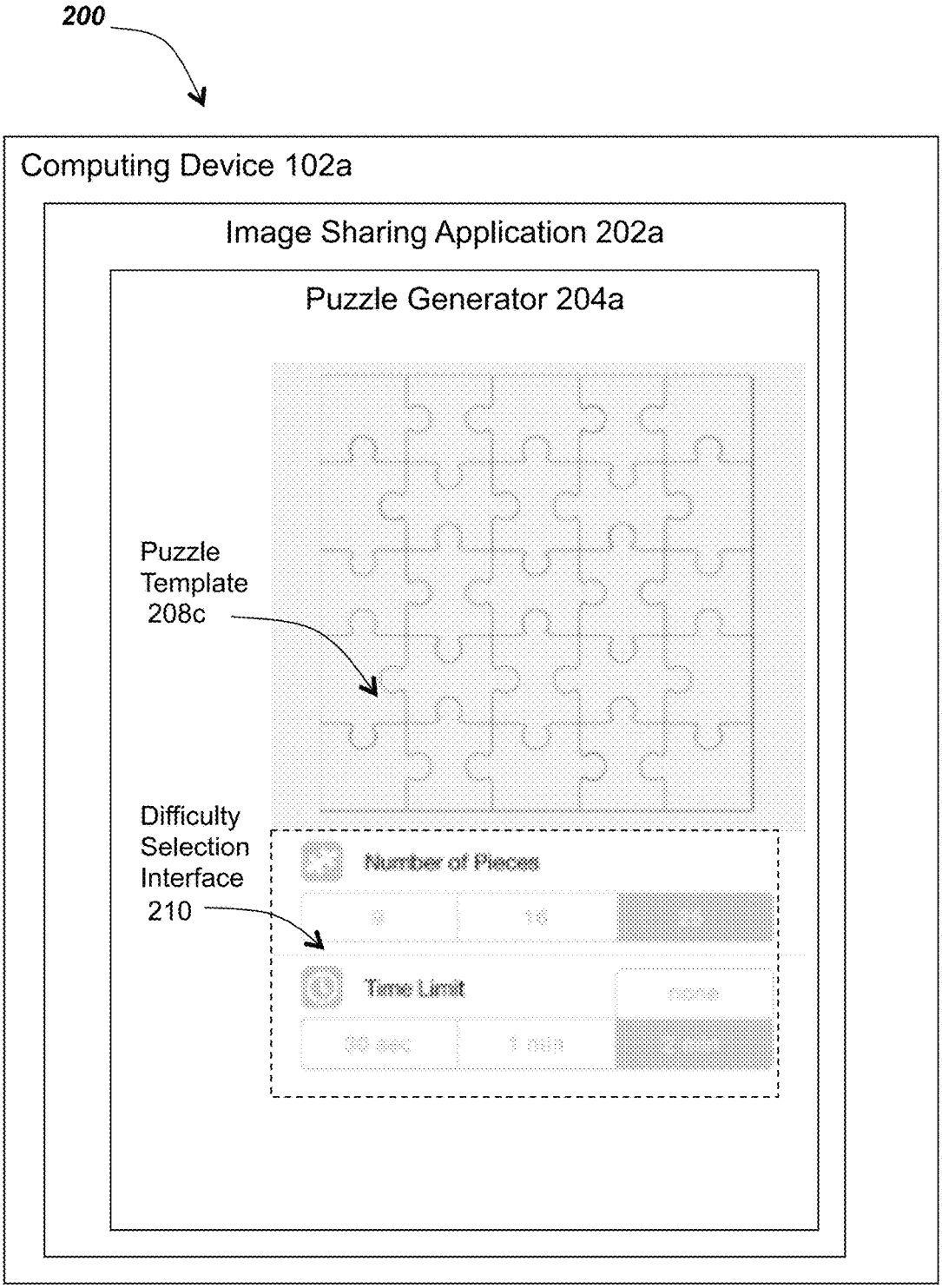

Referring now to FIGS. 2C-2E, block diagrams depict embodiments of a system 200 for interactive image sharing including a puzzle template 208. As shown in FIG. 2C, the puzzle generator 204*a* may select a puzzle template 208 for use in generating a plurality of puzzle piece images based on an image selected by a user of the image sharing application 202*a* (e.g., selected via the image selection interface 206). In one embodiment, the puzzle generator 204*a* has a default puzzle template used for generating all puzzles. Although depicted as a square in FIG. 2C, the puzzle template 208 may be rectangular or any other shape. In other embodiments, and as depicted in FIG. 2D, the puzzle generator 204*a* selects a puzzle template from a plurality of puzzle templates. In one of these embodiments, the puzzle generator 204*a* receives user input and makes the selection of the puzzle template based on the received user input. By way of example, and as shown in FIG. 2D, the puzzle generator 204*a* may optionally display a difficulty selection interface 210 (depicted in shadow in FIG. 2D) for receiving user input identifying a level of difficulty for the puzzle to be generated. The display selection interface may provide one or more interfaces for selecting different types of difficulties. For example, as shown in FIG. 2D, a difficulty selection interface 210*a* may allow a user to set a level of difficulty by modifying a number of pieces to be generated for a puzzle based on an image selected for sharing. As another example, also shown in FIG. 2D, a difficulty selection interface 210*b* may allow a user to set a level of difficulty by modifying an amount of time allotted to a recipient of the puzzle pieces for assembling the puzzle. In embodiments in which the difficulty selection interface 210 relates to a number of puzzle pieces to be generated, the puzzle generator 204*a* may use the received user input when generating the puzzle pieces (for example, and without limitation, receiving "16" in difficulty selection interface 210*a* and selecting a puzzle template 208*b* for generating 16 puzzle pieces instead of selecting a puzzle template 208*a* for generating nine puzzle pieces). As an additional example, and without limitation, FIG. 2E depicts a puzzle template 208*c* with which the puzzle generator 204*a* may generate 25 puzzle pieces. As one of ordinary skill in the art will understand, puzzle templates 208*a-c* are provided only by way of example, without limitation, and puzzle templates may come in a variety of types. For example, one type of puzzle template may be associated with novice users while another type of puzzle template may be associated with regular users of the application 202 or users who self-identify as experienced puzzle aficionados. As another example, puzzle templates may be selected for generating puzzles that include at least one nonstandard puzzle piece, such as at least one themed or whimsical puzzle piece (e.g., animal or flower shapes, food shapes, holiday shapes, or any other type of nontraditional puzzle piece).

Figure 2F:
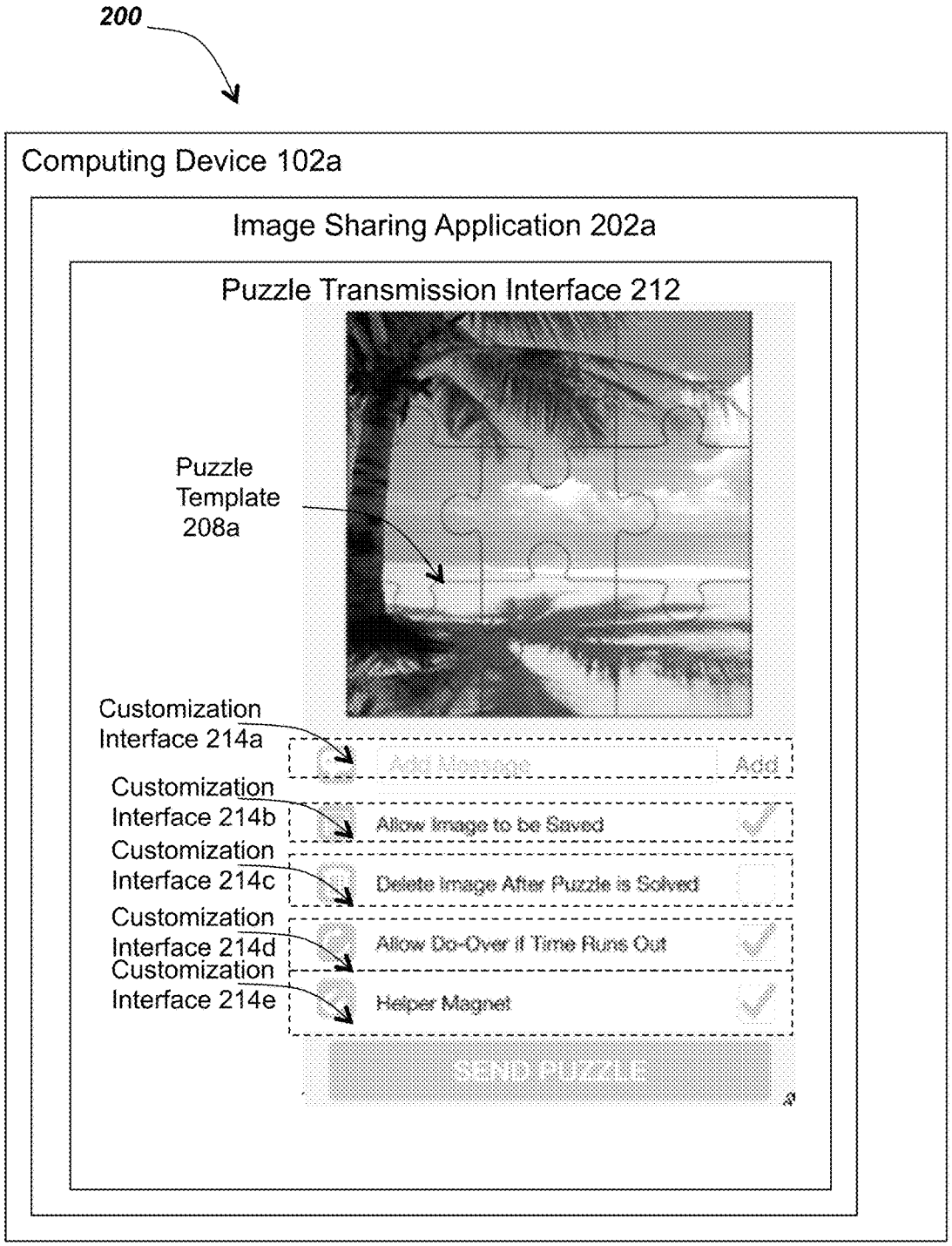
FIG. 2F is a block diagram depicting an embodiment of a user interface for viewing an image to be shared as a puzzle with the selected puzzle template overlaid on the image.

Referring now to FIG. 2F, a block diagram depicts an embodiment of a puzzle transmission interface 212 for viewing an image to be shared as a puzzle with the selected puzzle template 208 overlaid on the image. As shown in FIG. 2F, the puzzle transmission interface 212 may include one or more optional interface elements 214*a-e* with which the user sending the image may customize the receiving user's experience. For example, and as depicted in FIG. 2F, the puzzle transmission interface 212 may include an interface element 214*a* with which the sending user may add a message to the receiving user. As another example, the puzzle transmission interface 212 may include an interface element 214*b* with which the sending user may specify whether to allow the receiving user to save the shared image (e.g., on the receiving user's local device). As still another example, the puzzle transmission interface 212 may include an interface element 214*c* with which the sending user may specify whether the puzzle assembly interface 220 is to delete the image after the receiving user completes the puzzle. In an alternative embodiment (not shown) the puzzle transmission interface 212 includes either interface element 214*b* or interface element 214*c* but not both. As another example, the puzzle transmission interface 212 may include an interface element 214*d* with which the sending user may specify whether the puzzle assembly interface 220 is authorized to provide the receiving user with multiple opportunities to complete the puzzle if the receiving user fails to complete the puzzle within an initial time-out period. In contrast, the sending user may specify that the puzzle assembly interface 220 is not authorized to allow the receiving user to view the shared image if she does not complete the puzzle. As yet another example, the puzzle transmission interface 212 may include an interface element 214*d* with which the sending user may specify whether the puzzle assembly interface 220 is authorized to provide the receiving user with assistance in completing the puzzle (e.g., via a "help" function described in FIG. 2F as a "helper magnet").

In one embodiment, the puzzle assembly interface 220*a* provides a user interface (e.g., by displaying, or generating for display, the user interface on a physical computing device accessible by a user) with which a receiver of a puzzle may assemble a puzzle generated from a shared image and view the shared image.

In one embodiment, the image sharing application 202*b* executing on the second computing device 102*b* provides substantially the same functionality as the image sharing application 202*a* executing on the first computing device 102*a*. In another embodiment, the image sharing application 202*b* includes functionality for receiving a plurality of puzzle piece images and an original image associated with the plurality of puzzle piece images.

In some embodiments, the puzzle generator 204*b* executing on the second computing device 102*b* provides substantially the same functionality as the puzzle generator 204*a* executing on the first computing device 102*a*. In one of these embodiments, the puzzle generator 204*b* includes functionality for generating a puzzle assembly interface, confirming assembly of the plurality of puzzle piece images by a user of the first computing device, and displaying the original image associated with the plurality of puzzle piece images upon confirmation of assembly. In other embodiments, the puzzle assembly interface 220*b* executing on the second computing device 102*b* provides substantially the same functionality as the puzzle assembly interface 220*a* executing on the first computing device 102*a*.

Figure 2G:
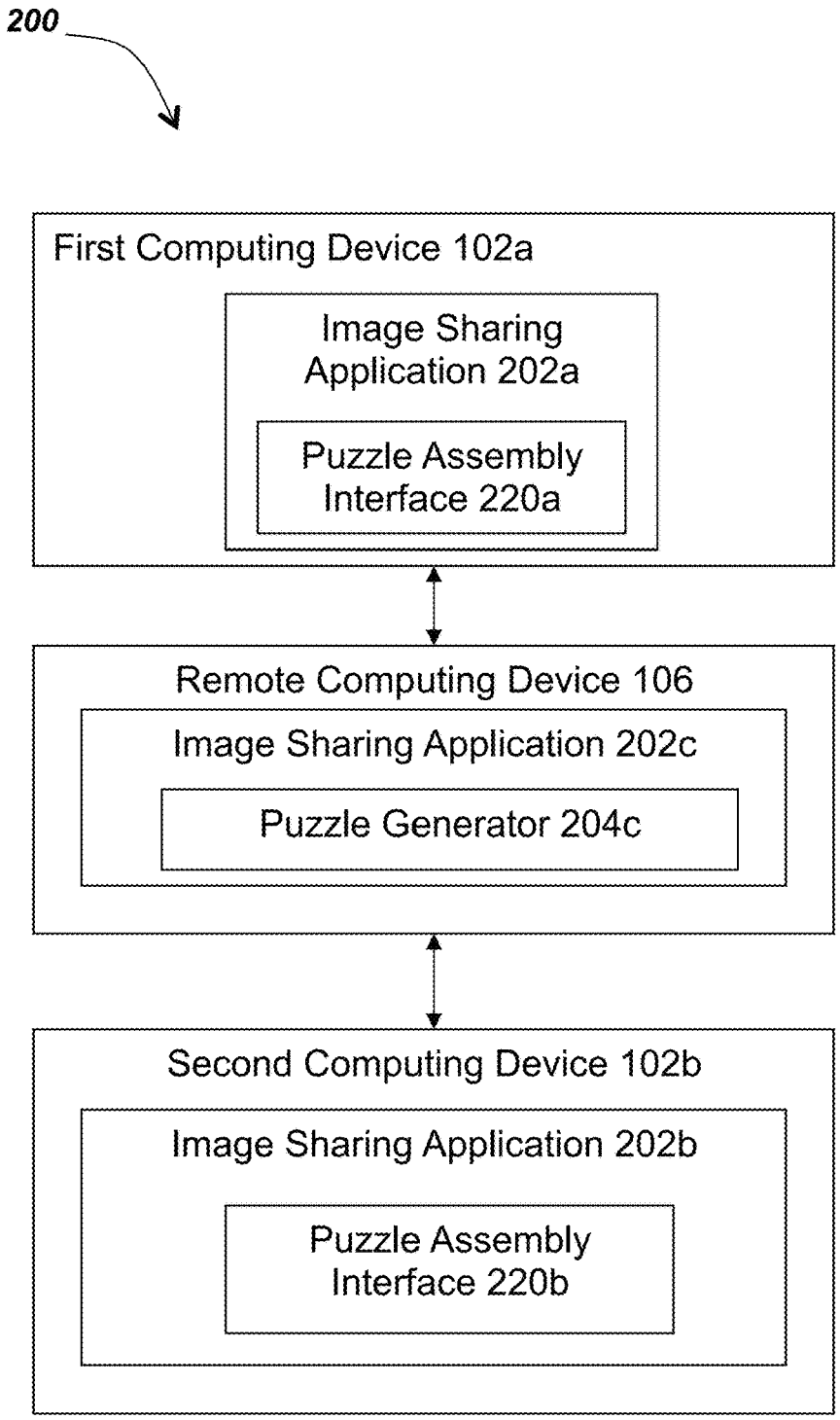
FIG. 2G is a block diagram depicting an embodiment of a system for interactive image sharing.

Referring now to FIG. 2G, a block diagram depicts an embodiment of a system for interactive image sharing. Although discussed herein as a system in which a first user (e.g., of a first computing device 102*a*) sends a puzzle and an image directly to a second user (e.g., of a second computing device 102*b*), in some embodiments the first computing device 102*a* sends an image selected for sharing to the second computing device 102*b* indirectly, e.g., via one or more intermediate computing devices. For example, and as depicted in FIG. 2G, the first computing device 102*a* may transmit the image selected for sharing to a remote computing device 106 (which may be provided as remote computing device 106 described above in connection with FIGS. 1A-1C). In one of these embodiments, the remote computing device 106 executes, is in communication with, or otherwise provides the functionality of the puzzle generator 204*c* instead of the first computing device 102*a*. In another of these embodiments, the remote computing device 106 generates the plurality of puzzle piece images based on the received image. In still another of these embodiments, the remote computing device 106 transmits the plurality of puzzle piece images to the second computing device 102*b* with the received image. Such embodiments may be useful for minimizing computational load on a computing device 102. Such embodiments may be useful for analyzing data associated with a plurality of users of image sharing applications 202*a-n*; for example, the remote computing device 106 may track record times amongst the plurality of users and make available a listing of users with the fastest times (e.g., leaderboards).

The image sharing application 202 may provide additional functionality for assisting users in sharing and assembling images. The image sharing application 202 may provide functionality for generating user profiles (e.g., selecting or changing profile images and switching from one profile to another). The image sharing application 202 may provide user interfaces for generating new puzzles (e.g., as discussed herein, without limitation, interfaces for selecting images (from camera rolls or by using the camera to generate a new image), selecting a level of difficulty (including a number of times which a receiving user may re-attempt puzzle assembly), adding a message, specifying whether to allow a recipient user to save an image or requiring an automatic deletion of the image, and specifying addressee information for one or more recipients). The image sharing application 202 may provide user interfaces for connecting with other users (e.g., adding connections or "friends," editing connections, viewing connection requests, sending puzzles to friends, and sending messages to connections). The image sharing application 202 may provide user interfaces for viewing messages (e.g., an "inbox" with which users may view a listing of new puzzles received or new messages from connections). The image sharing application 202 may provide user interfaces for viewing puzzles created and identifications of completion levels of shared puzzles. The image sharing application 202 may provide user interfaces for modifying user settings or preferences such as whether or not to play sound or music, whether to double check instructions before executing instructions, and account settings such as password changes, electronic mail settings, and account deletion.

Figure 2H:
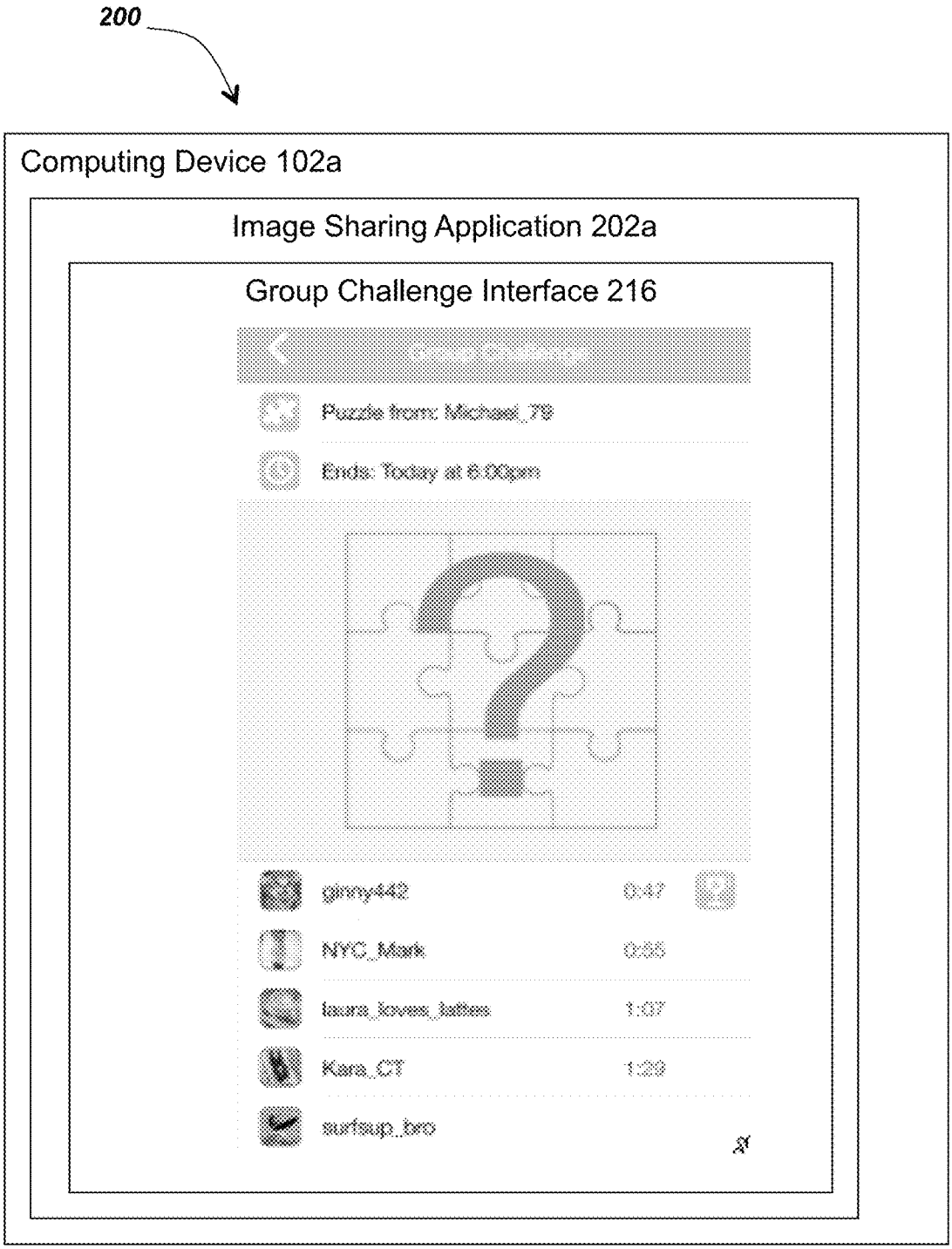
FIGS. 2H and 2I are block diagrams depicting embodiments of user interfaces for completion, by a plurality of recipients, of a puzzle based on a shared image.
Figure 2I:
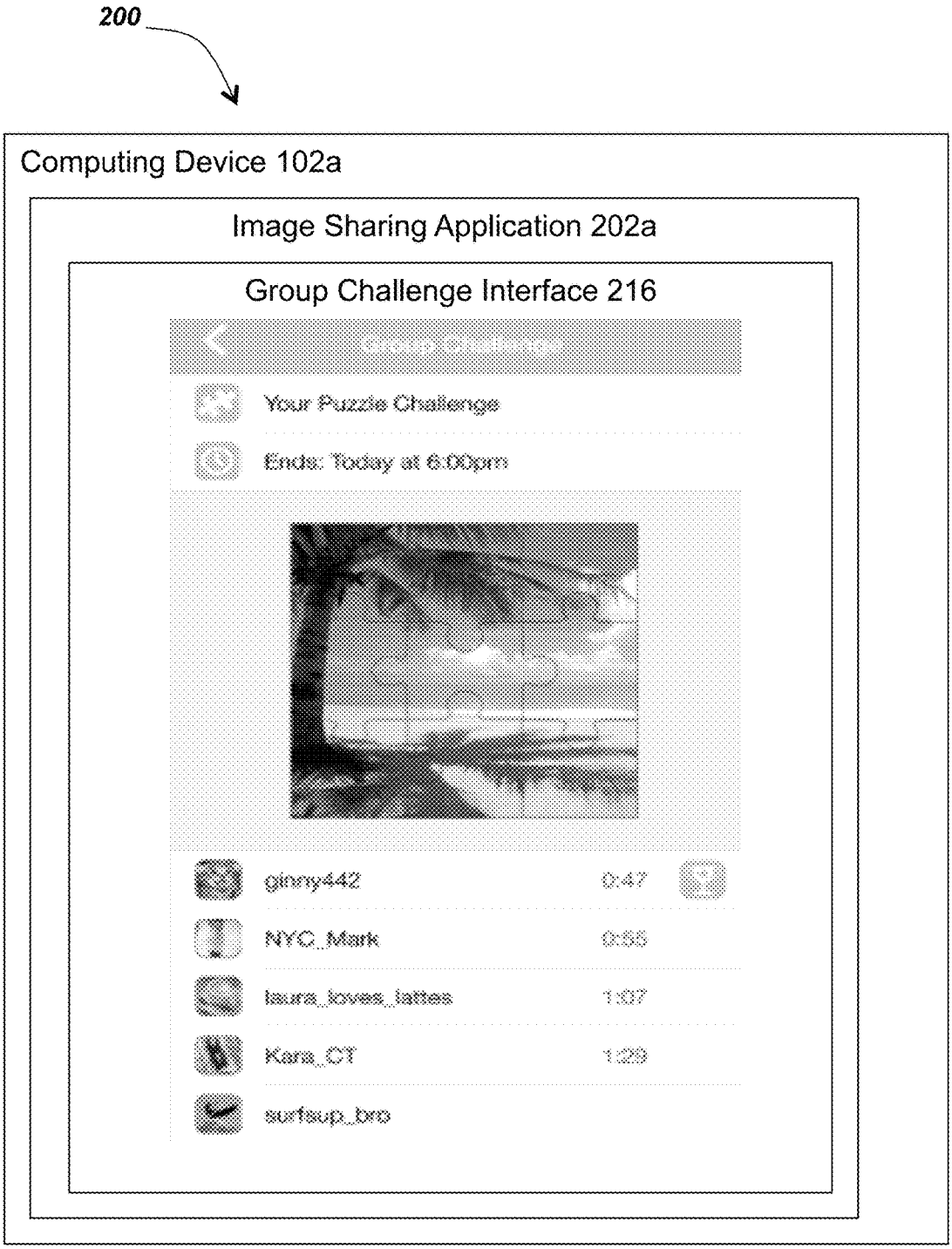
Figure 3A:
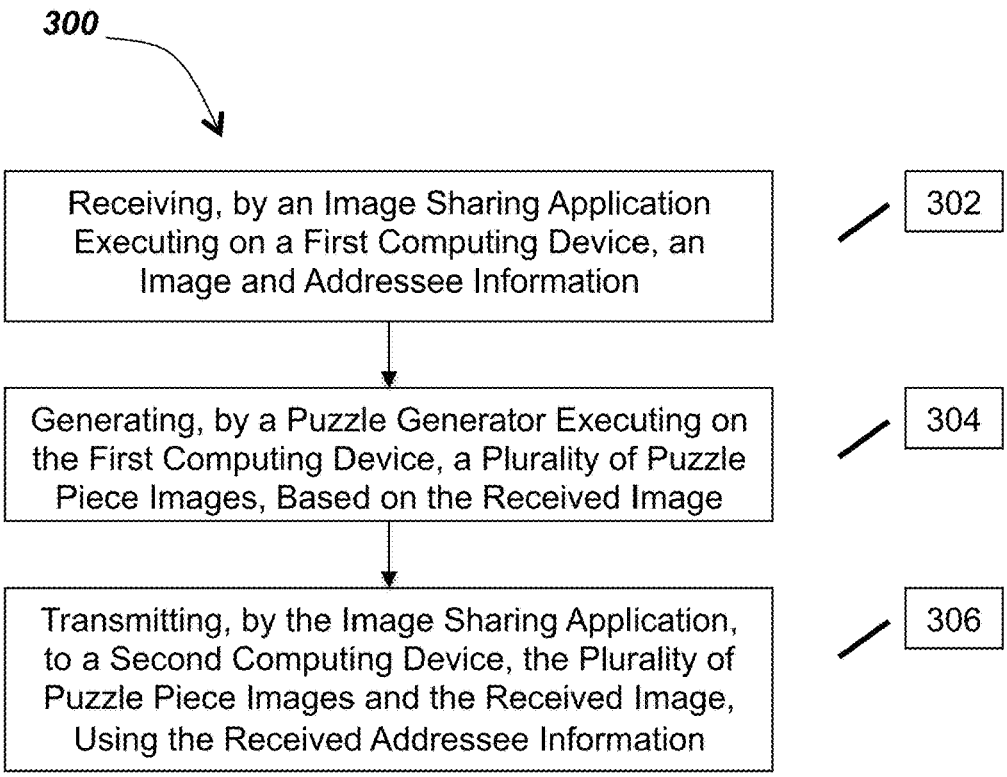
FIG. 3A is a flow diagram depicting an embodiment of a method for interactive image sharing.

Referring now to FIG. 3A, and in connection with FIG. 2A-2I, a flow diagram depicts one embodiment of a method 300 for interactive image sharing. The method 300 includes receiving, by an image sharing application executing on a first computing device, (i) an image and (ii) addressee information (302). The method 300 includes generating, by a puzzle generator executing on the first computing device, a plurality of puzzle piece images, based on the received image (304). The method 300 includes transmitting, by the image sharing application, to a second computing device, the plurality of puzzle piece images and the received image, using the received addressee information (306).

The method 300 includes receiving, by an image sharing application executing on a first computing device, (i) an image and (ii) addressee information (302). In one embodiment, the image sharing application 202*a* receives an identification of the image from a user of the image sharing application 202. In another embodiment, the image sharing application 202*a* receives an identification of a location on the first computing device 102*a* of the image. In still another embodiment, the image sharing application 202*a* receives an identification of the image to be shared via an image selection interface 206.

In one embodiment, the image sharing application 202*a* receives addressee information including an email address of an individual with whom the image is to be shared. In another embodiment, the image sharing application 202*a* receives addressee information including a username of an individual with whom the image is to be shared; for example, if the intended recipient has a computing device 102*b* on which she executes a copy of the image sharing application 202*b* and the intended recipient has established a username within the image sharing application 202*b*, the username may be sufficient for determining how to transmit the image to be shared to the intended recipient. In still another embodiment, the image sharing application 202*a* receives addressee information including a third-party identifier assigned to the intended recipient; by way of example, the intended recipient may have authorized a third-party social media service to make the third-party identifier available to the image sharing application 202*a*—for example, when accepting a connection request from the user attempting to share the image. In yet another embodiment, the image sharing application 202*a* receives addressee information including a mobile phone number of the intended recipient, with which the image sharing application 202*a* may transmit data via a short message service (SMS) or other text-based messaging service (e.g., for use in sending a uniform resource locator with which the recipient can access a location of the plurality of puzzle pieces). In some embodiments, in addition to the addressee information, the image sharing application 202*a* receives a message for transmission to the second computing device 102*b* with the plurality of puzzle piece images.

The method 300 includes generating, by a puzzle generator executing on the first computing device, a plurality of puzzle piece images, based on the received image (304). In one embodiment, the puzzle generator 204*a* makes a copy of the received image. In another embodiment, the puzzle generator 204*a* selects a puzzle template 208. As discussed above in connection with FIG. 2D, the puzzle generator 204*a* may receive user input that the puzzle generator 204*a* uses in selecting the puzzle template 208 from a plurality of puzzle templates. For example, the puzzle generator 204*a* may receive an identification of a level of difficulty for use in generating the plurality of puzzle piece images. Continuing with this example, the puzzle generator 204*a* may select a number of puzzle piece images to generate based on the received identification of the level of difficulty. In still another embodiment, the puzzle generator 204*a* uses the puzzle template 208 to divide the copy of the received images into a plurality of sub-images, referred to herein as the plurality of puzzle piece images. For example, although represented graphically in FIGS. 2C-2E for ease of discussion, the puzzle template 208 may be a sequence of numbers identifying coordinates within an image at which the puzzle generator 204*a* should divide the image into a set of sub-images. By way of example, and without limitation, the puzzle template 208 may indicate that the puzzle generator 204*a* should copy the section of the received image that corresponds to the top left quadrant (for example) and generate a new image from the copied section to create a first sub-image or puzzle piece image. The puzzle template 208 may provide sophisticated instructions to the puzzle generator 204*a* to generate standard or non-standard puzzle pieces.

In one embodiment, the puzzle generator 204*a* leverages commercially available software for generating a plurality of puzzle piece images from a received image.

The method 300 includes transmitting, by the image sharing application, to a second computing device, the plurality of puzzle piece images and the received image, using the received addressee information (306). In one embodiment, the image sharing application 202*a* also transmits a message from the sending user of the first computing device 102*a* to a recipient user of the second computing device 102*b*; for example, the sending user may have specified the message when identifying the image to be shared. In another embodiment, the image sharing application 202*a* receives an identification of a time limit to associate with the plurality of puzzle piece images from the user providing the received image; in such an embodiment, the image sharing application 202*a* may transmit the identification of the time limit to the second computing device 102*b* with the plurality of puzzle piece images.

In some embodiments, the image sharing application 202*a* receives, from the second computing device 102*b*, an indication that a user of the second computing device has assembled a puzzle using the plurality of puzzle piece images. In one of these embodiments, the image sharing application 202*a* receives a message for the sending user from the receiving user (e.g., regarding the completed puzzle). In other embodiments, the image sharing application 202*a* receives, from the second computing device 102*b*, an indication that a user of the second computing device failed to assemble a puzzle using the plurality of puzzle piece images. In one of these embodiments, the image sharing application 202*a* re-transmits the plurality of puzzle piece images and the received image. In another of these embodiments, the image sharing application 202*a* allows the sending user to transmit another message to the recipient user regarding the failure to complete the puzzle.

Referring now to FIGS. 2H and 2I, block diagrams depict embodiments of user interfaces for completion, by a plurality of recipients, of a puzzle based on a shared image. In some embodiments, the image sharing application 202*a* receives an instruction from a sending user to transmit the plurality of puzzle piece images to a plurality of addressees. For example, the sending user may wish to create a competition among the plurality of receiving users to see which of the plurality of receiving users can assemble the puzzle piece images first. Such a "group challenge" allows the sending user to share the image in a way that engages a plurality of recipients, encouraging communication and interaction between and amongst the plurality of recipients. In one embodiment, a "group challenge" feature allows the sending user to send the same puzzle (e.g., the image to be shared and the plurality of puzzle piece images) simultaneously to the plurality of recipients. For example, the sending user may select the plurality of recipients from a contact list, list of "friends" within the application, address book, or other listing of users available to receive shared images. In another embodiment, the recipients complete the individual puzzles on their respective devices (e.g., independently of one another).

As shown in FIG. 2H, the image sharing application 202*a* may provide a group challenge interface 216 with which a receiving user may view data associated with a group challenge, such as an identifier associated with a sending user. The group challenge interface 216 may allow the receiving user to view a time period in which the receiving user may complete the puzzle; although depicted in FIGS. 2H and 2I as a time at which the puzzle becomes unavailable (e.g., 6 pm), one of ordinary skill in the art will note that other forms of time period are available, such as listing an amount of time the recipient user may spend on assembling the puzzle (e.g., five minutes). The group challenge interface 216 may allow the receiving user to access the puzzle, for example, by clicking on an image of a puzzle (depicted in FIG. 2H as a puzzle with a question mark on it). The group challenge interface 216 may provide the functionality of a puzzle assembly interface 220. Alternatively, the group challenge interface 216 may be in communication with the puzzle assembly interface 220; for example, the group challenge interface 216 may receive an indication that the receiving user wishes to complete the puzzle (e.g., because the receiving user clicked on the image of the puzzle template) and instantiate the puzzle assembly interface 220.

In one embodiment, the puzzle assembly interface 220 tracks the amount of time it takes each individual recipient to complete the puzzle and shares the amount of time with at least one other computing device 100—for example, the sending user's device may receive reports from each of the plurality of recipients (e.g., from each recipient's computing device 100) or an intermediate machine such as remote computing device 106 in FIG. 2G may receive the amount of time from each recipient's computing device 100. A computing device 100 receiving the amount of time each of the recipients needed to complete the puzzle may rank the recipients according to the amount of time taken (e.g., lowest to highest or highest to lowest). In another embodiment, the computing device 100 receiving the amount of time each of the recipients needed to complete the puzzle may generate a listing of an identifier of each of the recipients, organizing the listing according to the ranking; such a listing may be referred to as a "leaderboard." The computing device 100 receiving the amount of time may transmit a notification to each of the plurality of recipients indicating which recipient had the lowest amount of time (and therefore may be considered to have "won" the group challenge) and providing access to the leaderboard. Such a leaderboard may be displayed when the recipient user receives the challenge (e.g., upon viewing the group challenge interface 216 as shown in FIG. 2H). Alternatively, the leaderboard may be displayed when the recipient user completes the challenge as shown in FIG. 2I. As another example, the leaderboard may be displayed upon receipt of the challenge as shown in FIG. 2H and updated upon completion of the challenge by any of the plurality of recipients as shown in FIG. 2I. In some embodiments, as depicted in FIGS. 2H and 2I, the shared image is only available after the receiving user has completed assembling the puzzle (e.g., as shown in FIG. 2I).

In one embodiment, when creating the group challenge, the sending user can set a time period for completing the challenge, requesting that each of the plurality of recipients complete the challenge puzzle before the expiration of the time period. In such an embodiment, recipients who complete the puzzle after the time period has expired may not receive a time or ranking among the plurality of recipients; likewise, if receivers fail the puzzle or do not play it at all, they may not be ranked amongst the plurality of recipients.

Figure 2J:
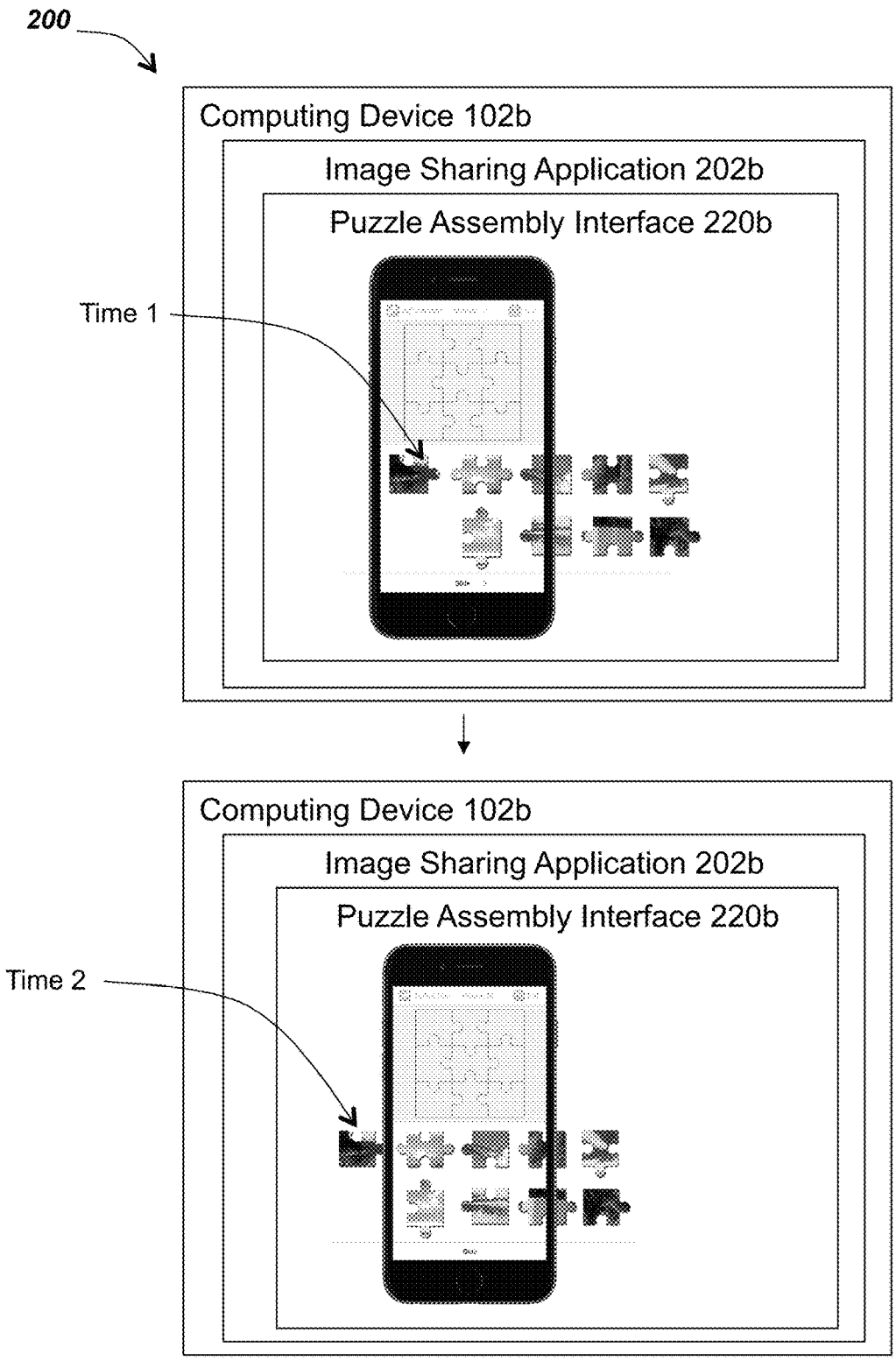
FIG. 2J is a block diagram depicting one embodiment of a user interface for viewing a plurality of puzzle piece images.
Figure 2K:
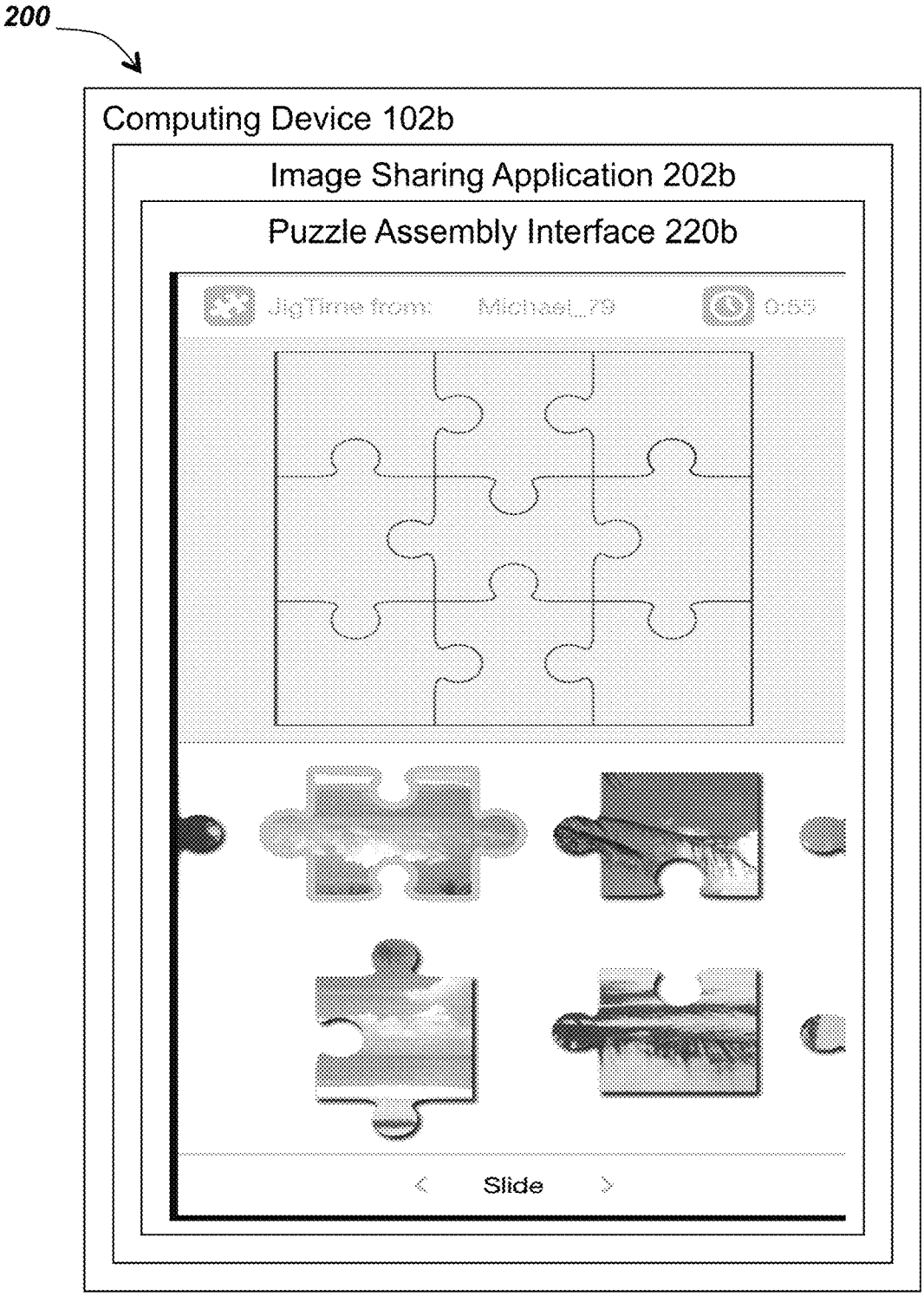
FIG. 2K is a block diagram depicting one embodiment of a user interface confirming a user selection of one of a plurality of puzzle piece images.
Figure 2L:
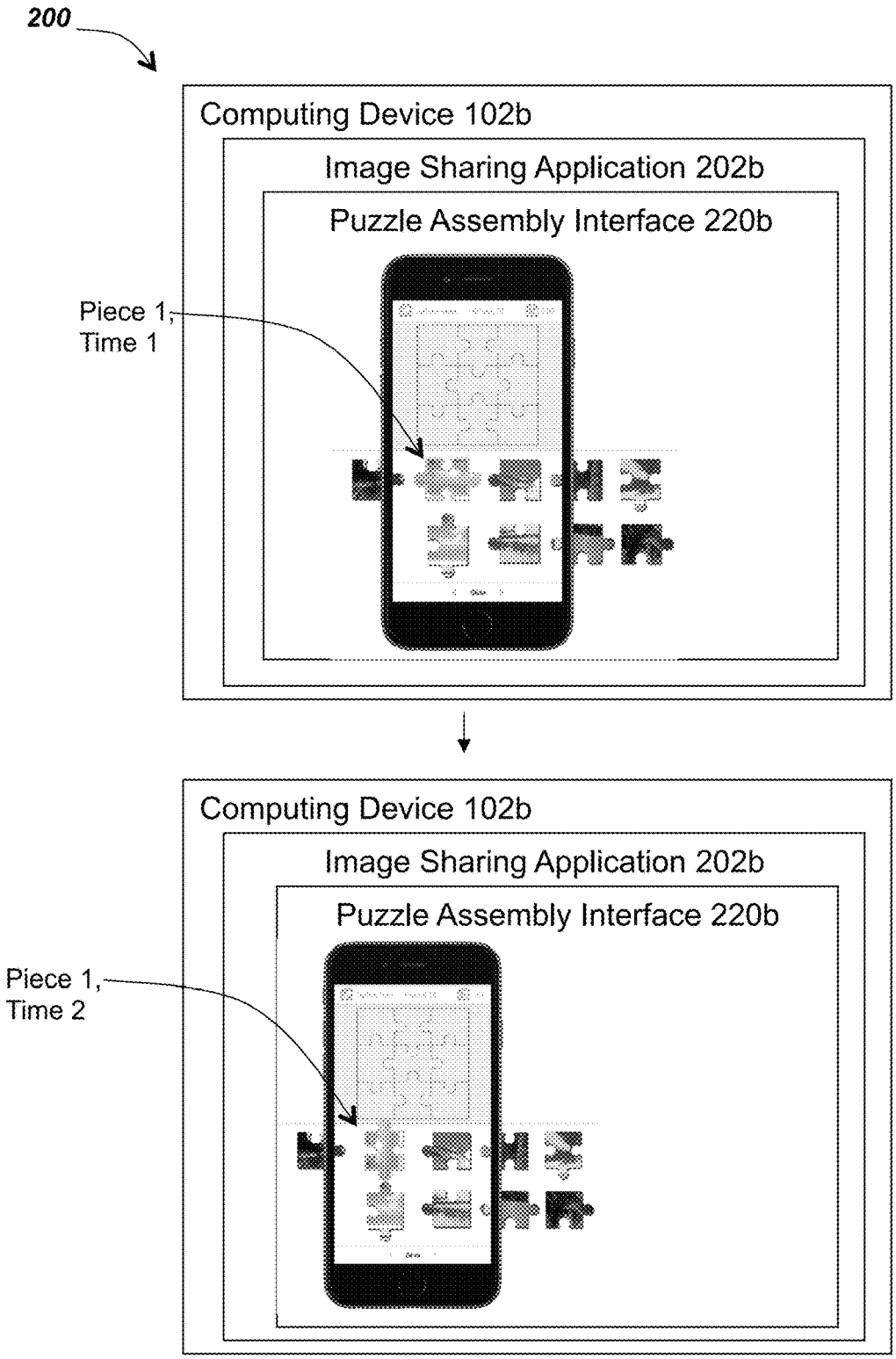
FIG. 2L is a block diagram depicting one embodiment of a user interface allowing a user to rotate a puzzle piece image.
Figure 2M:
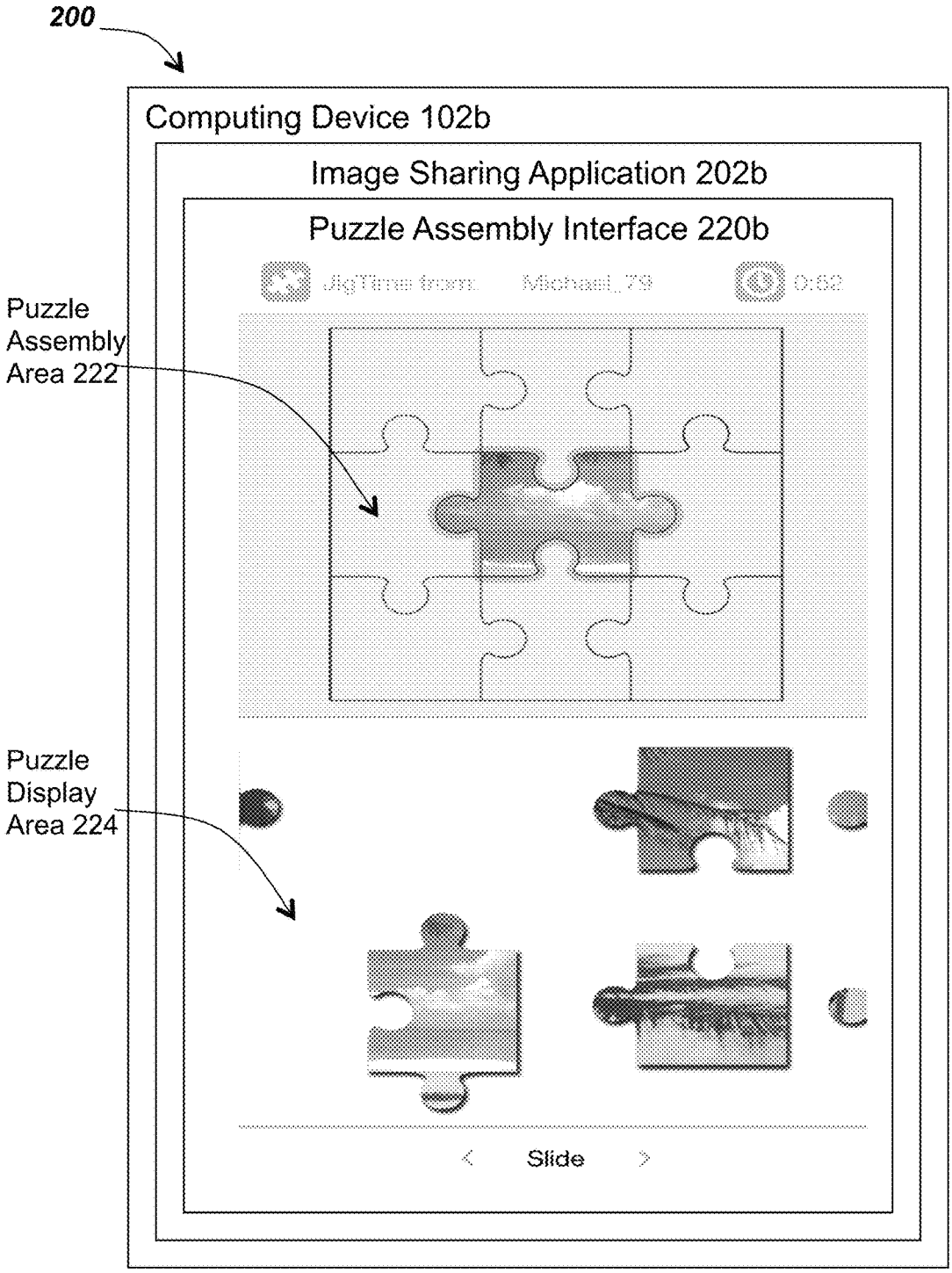
FIGS. 2M-2N are block diagrams depicting a puzzle assembly interface displaying an updated version of a puzzle assembly area and of a puzzle piece display area.
Figure 2N:
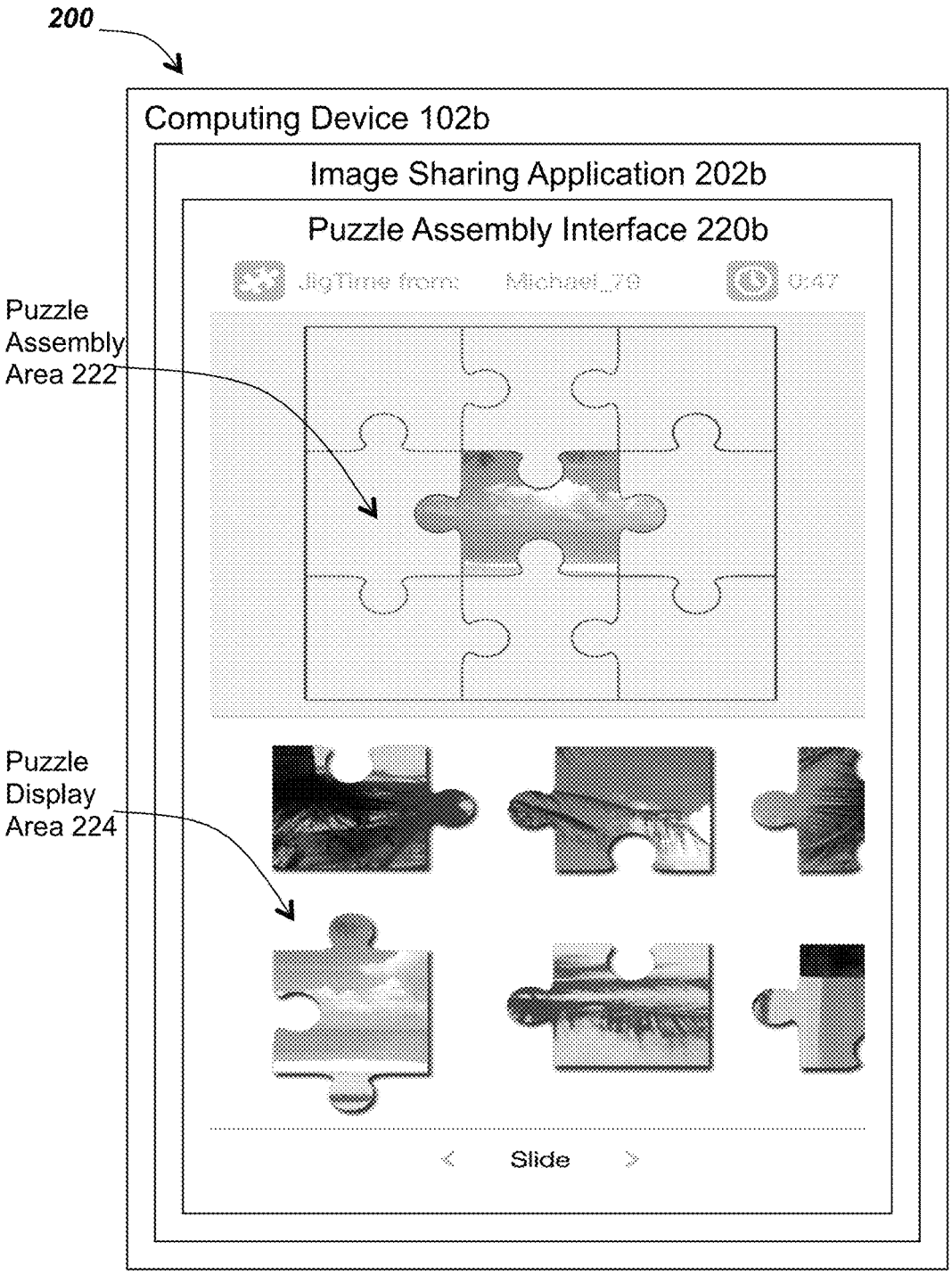
Figure 2O:
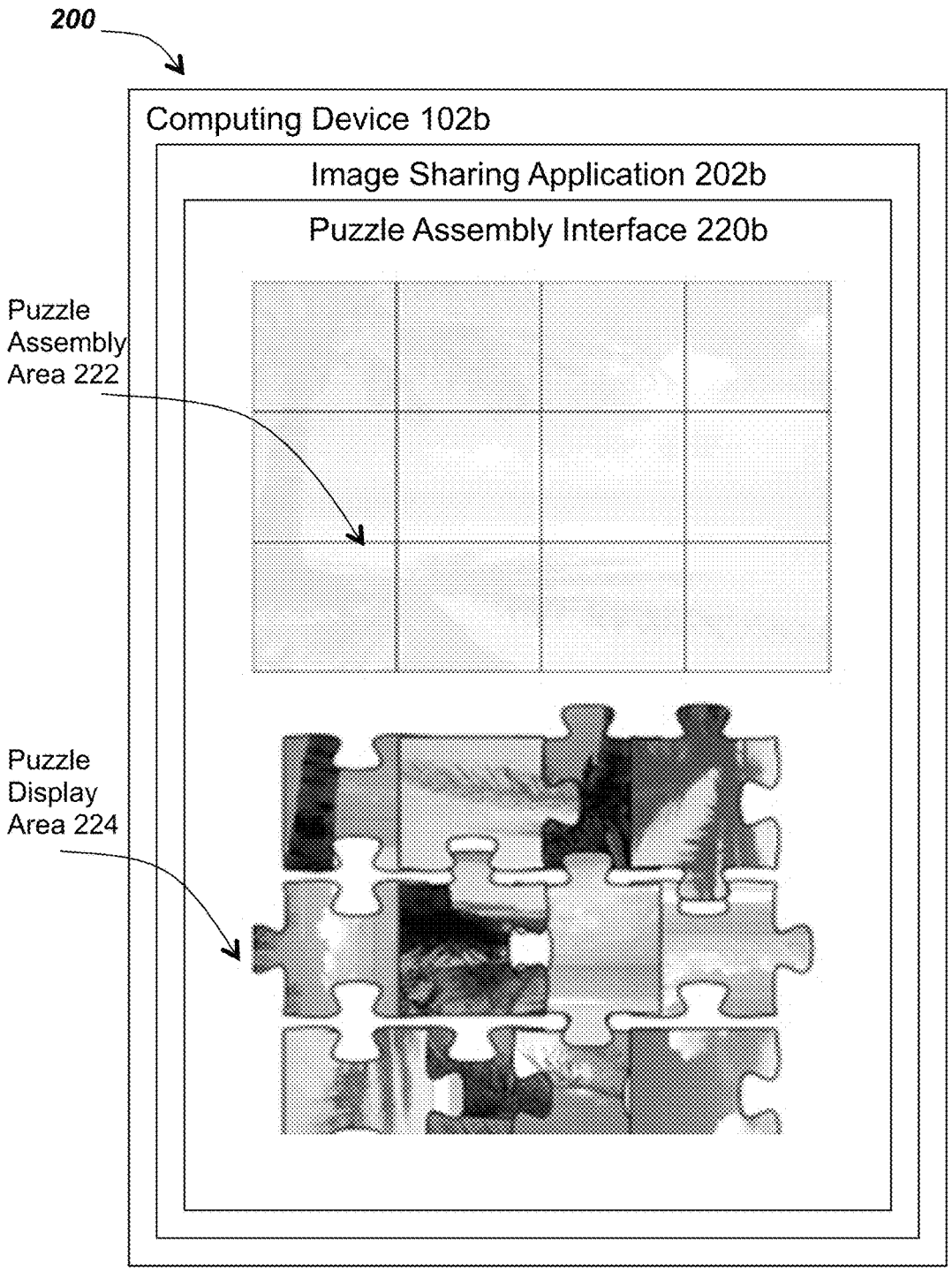
FIG. 2O is a block diagram depicting one embodiment of a user interface for viewing a plurality of puzzle piece images.
Figure 2P:
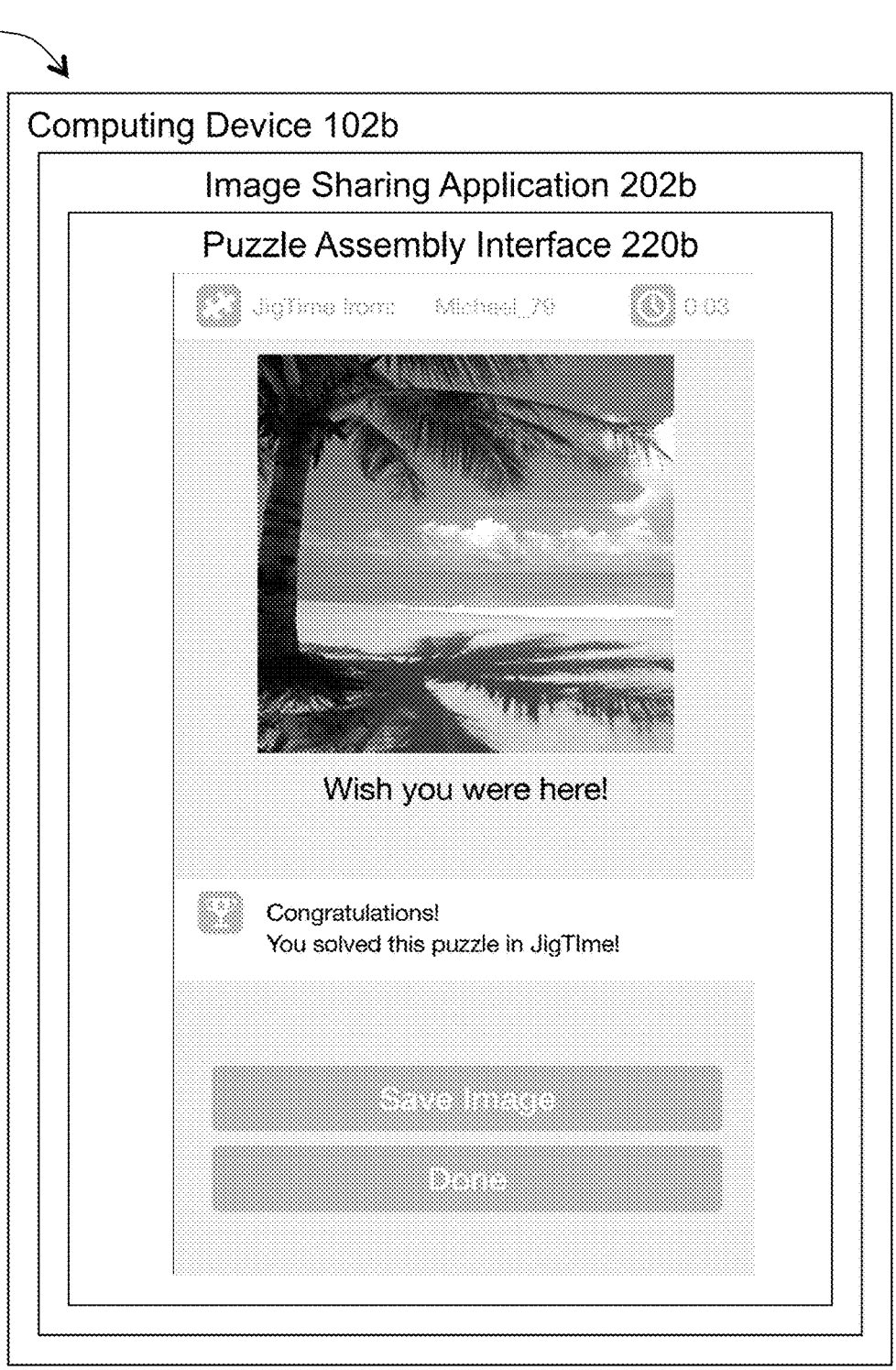
FIG. 2P is a block diagram of a puzzle assembly interface generated by a puzzle generator and providing a user with the option of saving an image.
Figure 3B:
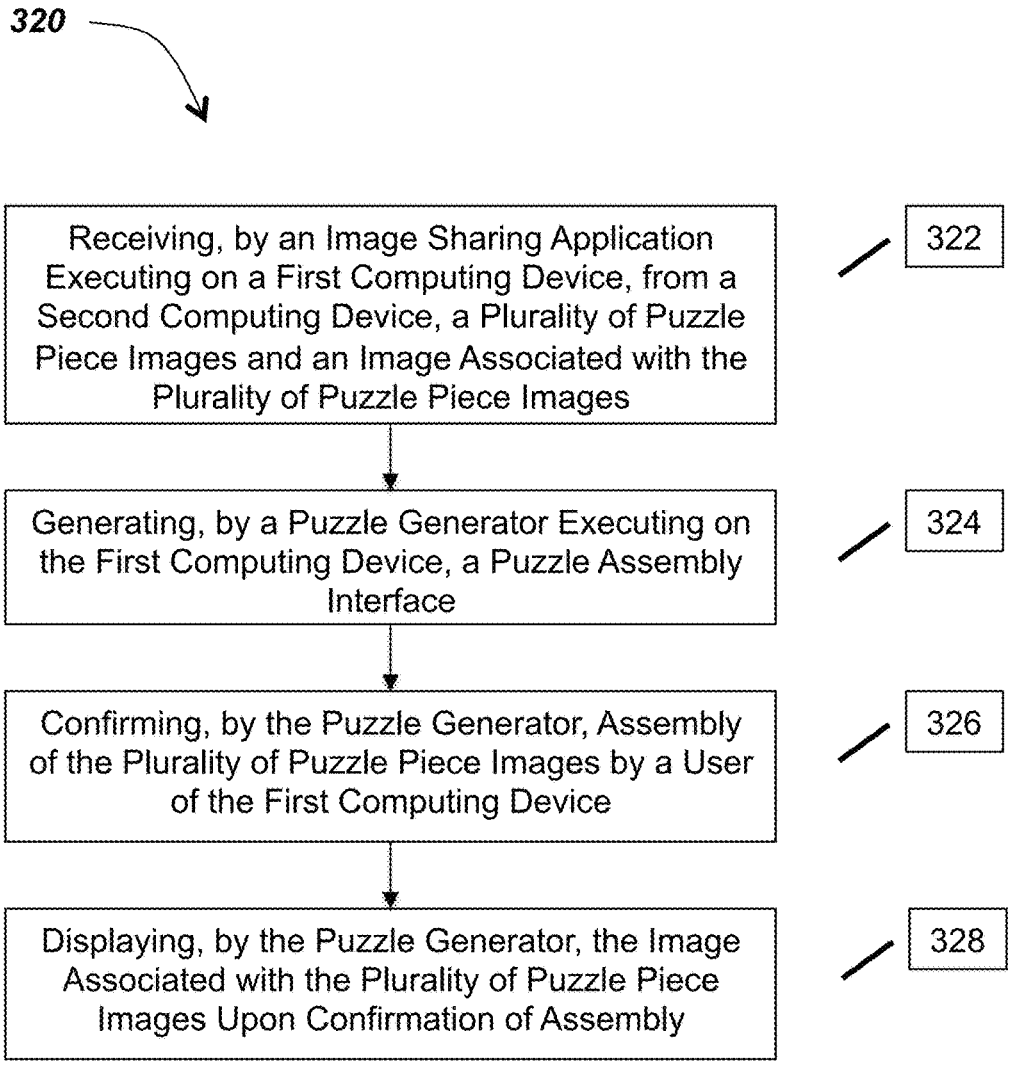
FIG. 3B is a flow diagram depicting an embodiment of a method for interacting with a shared image.

Referring now to FIG. 3B, and in connection with FIGS. 2A-2P, a flow diagram depicts one embodiment of a method 320 for interacting with a shared image. The method includes receiving, by an image sharing application executing on a first computing device, from a second computing device, a plurality of puzzle piece images and an image associated with the plurality of puzzle piece images (322). The method includes generating, by a puzzle generator executing on the first computing device, a puzzle assembly interface (324). The method includes confirming, by the puzzle generator, assembly of the plurality of puzzle piece images by a user of the first computing device (326). The method includes displaying, by the puzzle generator, the image associated with the plurality of puzzle piece images upon confirmation of assembly (328).

The method includes receiving, by an image sharing application executing on a first computing device, from a second computing device, a plurality of puzzle piece images and an image associated with the plurality of puzzle piece images (322). In one embodiment, the image sharing application 202*b* receives the plurality of puzzle piece images and the image associated with the plurality of puzzle piece images from the image sharing application 202*a*. In another embodiment, the image sharing application 202*b* receives an identification of the user of the computing device that initiated transmission of the image; the image sharing application 202*b* may later use this information to provide status updates regarding a level of completion of the shared puzzle.

In one embodiment, the image sharing application 202*b* receives a puzzle template associated with the plurality of puzzle piece images. In another embodiment, the image sharing application 202*b* receives an identification of a puzzle template to associate with the plurality of puzzle piece images.

The method includes generating, by a puzzle generator executing on the first computing device, a puzzle assembly interface (324). In one embodiment, the puzzle generator 204*b* generates a user interface for assembling the plurality of puzzle piece images, based on a puzzle template. In another embodiment, the puzzle generator 204*b* uses an identification of a puzzle template to select a locally stored puzzle template to generate the puzzle assembly interface.

Referring still to FIG. 3B, and in connection with FIG. 2J, a block diagram depicts one embodiment of a user interface for viewing a plurality of puzzle piece images. In one embodiment, the puzzle generator 204*b* generates a display of at least one of the plurality of puzzle piece images. By way of example, the puzzle generator 204*b* may generate a display of a "table top" area within the puzzle assembly interface 220*b*, simulating the experience of having a table on which to place physical puzzle pieces. The puzzle generator 204*b* may reserve a portion of the puzzle assembly interface 220*b* for viewing a subset of the puzzle piece images; the portion reserved may be based on the size of the pieces or on user preferences. For example, and without limitation, the puzzle generator 204*b* may reserve enough display space to display nine small pieces or three large pieces. As another example, a user may specify that the puzzle generator 204*b* should reserve sufficient display space to always display a specified number of pieces (e.g., eight or all of the pieces). As another example, the puzzle generator 204*b* may generate resized versions of the puzzle piece images to display in the puzzle assembly interface 220*b*. In one embodiment, the puzzle generator 204*b* may change the puzzle piece images displayed within the puzzle assembly interface 220*b* upon receiving a request to do so by a user. For example, and as depicted by FIG. 2J at "Time 1," the user may provide an instruction to view more or different pieces (e.g., by using a pointing device to click on an arrow, chevron, or other symbol requesting more pieces, or by using a touch screen interface to make a gesture indicating the user wishes to scroll to a different part of the "table" and view different pieces); at "Time 2" the puzzle generator 204*b* may receive the instruction and replace at least one piece image displayed in the puzzle assembly interface 220*b* based upon the received instruction—in FIG. 2J, the display screen of the device 102*b* shows four whole pieces and two half pieces at "Time 2" instead of three whole pieces and two half pieces as were shown at "Time 1."

Referring still to FIG. 3B, and referring ahead to FIG. 2O, a block diagram depicts one embodiment of a user interface for viewing a plurality of puzzle piece images. In contrast to FIG. 2J, where only a subset of the plurality of puzzle piece images were displayed in the "table top" area within the puzzle assembly interface 220*b*, in FIG. 2O, all available pieces are displayed in the puzzle display area 224.

Referring still to FIG. 3B, and referring back to FIG. 2K, a block diagram depicts one embodiment of a user interface confirming a user selection of one of a plurality of puzzle piece images. In one embodiment, the puzzle generator 204*b* generates a user interface within the puzzle assembly interface 220*b* with which the user may select at least one of the plurality of puzzle piece images and indicate a location in the puzzle assembly interface in which to display the at least one of the plurality of puzzle piece images. For example, and without limitation, the puzzle generator 204*b* may allow a user to interact via a touch screen (e.g., allowing a user to make a tap-and-drag gesture on the screen; as another example, in a device with "3D Touch" functionality, a user may issue a command to rotate a piece by pressing down on the device) or pointing device or keyboard or any combination thereof to provide instructions as to where to move the puzzle piece images. As shown in FIG. 2K, the user interface may display a modified version of the selected puzzle piece image to provide visual confirmation that the user interface received the user's selection of the piece; in FIG. 2K, this is depicted by displaying a version of the non-frame piece in the upper left position with an additional border around the image.

Referring still to FIG. 3B, and in connection with FIG. 2L, a block diagram depicts one embodiment of a user interface allowing a user to rotate a puzzle piece image. In some embodiments, the puzzle generator 204*b* provides functionality within the puzzle assembly interface 220*b* allowing a user to provide an instruction to rotate an identified puzzle piece image. In one of these embodiments, upon receiving the instruction from the puzzle assembly interface 220*b*, the puzzle generator 204*b* generates or accesses a version of the identified puzzle piece image having a different orientation than the identified puzzle piece image and displays the "rotated" image. In some of these embodiments, the puzzle generator 204*b* may display puzzle piece images in different orientations each time a user re-does a puzzle. In other embodiments, the puzzle generator 204*b* displays the puzzle piece images with realistic 3-D photographic and lighting effects. As shown in FIG. 2L, at "Time 1," "Piece 1" is a horizontally-placed, non-frame piece in the upper left-hand corner of the display of the computing device 102*b*; at "Time 2," "Piece 1" is a vertically-placed, non-frame piece in the upper left-hand corner of the display of the computing device 102*b*.

The method includes confirming, by the puzzle generator, assembly of the plurality of puzzle piece images by a user of the first computing device (326). In some embodiments, the puzzle generator 204*b* receives, from a user of the first computing device, an instruction to display one of the plurality of puzzle pieces at a location in the puzzle assembly interface. In other embodiments, the puzzle generator 204*b* confirms that the user attempting to assemble the plurality of puzzle piece images has provided an instruction to display each of the plurality of puzzle piece images in a location within the puzzle assembly interface that is substantially the same as a location within the puzzle template. In one embodiment, the puzzle generator 204*b* receives an identification of a location within a puzzle template, the location associated with one of the plurality of puzzle pieces and with a location on the puzzle assembly interface. By way of example, the puzzle generator 204*b* may receive an enumeration of puzzle pieces and a numbered location within a puzzle template associated with each enumerated puzzle piece. For example, in a simple puzzle with three pieces, each piece may be labeled "1," "2," or "3" and the puzzle template may have three spaces labeled "1," "2," and "3." The puzzle generator 204*b* may receive, from a user of the puzzle assembly interface 220*a*, an instruction to display one of the plurality of puzzle piece images at a location in the puzzle assembly interface. Continuing the example of the three-piece puzzle, the puzzle generator 204*b* may receive an instruction to display piece "1" in location "1" on the puzzle assembly interface. The puzzle generator 204*b* may use the identification of the location in the puzzle template, which corresponds to the puzzle assembly interface, to determine that location "1" in the puzzle template is substantially similar to (and/or associated with) location "1" in the puzzle assembly interface and conclude that the user has correctly identified the location of the puzzle piece in the puzzle, in which case, the puzzle generator 204*b* may display the image of the puzzle piece at the specified location in the puzzle assembly interface. Alternatively, continuing with this example, the puzzle generator 204*b* may receive an instruction to display piece "1" in location "3" on the puzzle assembly interface and conclude that the user has not correctly identified the location of the puzzle piece in the puzzle and conclude not to execute the user instruction to display the one of the plurality of puzzle piece images at the specified location. The example provided above is a simple example for ease of explanation; the puzzle generator 204*b* may implement sophisticated processes to determine whether the user has correctly identified a location in the puzzle assembly interface at which to display a particular puzzle piece. In other embodiments, the puzzle generator 204*b* may leverage commercially available software for generating puzzle assembly interfaces in order to allow a user to complete a puzzle based on an image shared by a second user.

Referring still to FIG. 3B, and in connection with FIGS. 2M-2N, the puzzle assembly interface 220*b* may display an updated version of a puzzle assembly area and of a puzzle piece display area (e.g., upon determining that the user has correctly placed a puzzle piece in the puzzle assembly area). As shown in FIG. 2M, the puzzle assembly interface 220*b* may display a puzzle assembly area 222 including a display of a properly placed puzzle piece image. As shown in FIG. 2M, upon confirmation that the user has placed the puzzle piece image in the correct location on the puzzle assembly area 222, the puzzle assembly interface 220*b* may remove the display of the puzzle piece image from the display of the plurality of puzzle piece images outside of the puzzle assembly area 222 (e.g., the puzzle display area 224). As shown in FIG. 2N, upon confirmation that the user has placed the puzzle piece image in the correct location on the puzzle assembly area 222, the puzzle assembly interface 220*b* may remove the display of the puzzle piece image from the display of the plurality of puzzle piece images outside of the puzzle assembly area 222 (e.g., the puzzle display area 224) and re-order the display of the remaining puzzle piece images so as to remove the blank space in the display that previously included the properly placed image.

In some embodiments, the puzzle generator 204*b* may provide functionality for assisting a user in assembling the plurality of puzzle piece images. In one of these embodiments, the puzzle generator 204*b* may provide a "magnet" feature that modifies a level of specificity a user needs to provide in identifying a location at which to display a puzzle piece image. For example, without the feature, a user may have to click, tap, or otherwise identify a location within the puzzle assembly interface 220*b* with a particular level of specificity; with the feature, the user may identify a location near the correct location for displaying the puzzle piece image but less accurately than would be required to meet the threshold level of specificity and the puzzle generator 204*b* will still display the puzzle piece image. That is, when the "magnet" function is enabled, the functionality allows the receiving user to place puzzle pieces in a much larger or much more generous "correct-placement-zone" than usual—creating the appearance that a puzzle piece is being pulled into its proper place (as if by a magnet) when the receiving user identifies an area in which to move the piece that is anywhere near the general vicinity of where it belongs. By way of non-limiting example, this feature may instruct the puzzle assembly interface 220*b* to consider a puzzle piece image properly placed when the receiving user identifies any area in—for example only—a quadrant of the puzzle assembly area that includes the correct placement; for pieces whose proper positions fall on either the vertical or horizontal axis, the feature may assist if those pieces are placed in either overlapping quadrant (or hemisphere). Continuing with this example, for any puzzle that contains an "exact center piece" (the single piece that falls at the center of all four quadrants), the feature may assist with the placement of such a piece when it is placed anywhere at all on the puzzle grid (because all quadrants apply as overlapping with its "correct-placement-zone").

In other embodiments, the puzzle generator 204*b* may receive an instruction to display a puzzle piece image in a location that is not correct but determine to display the puzzle piece image at a location near the incorrectly identified location. In one of these embodiments, for example, the puzzle generator 204*b* may overlay a display of a first puzzle piece image on top of a display of a second puzzle piece image, thus emulating a user's physical action of moving a physical puzzle piece to a space on or near other sections of a physical puzzle even without attempting to connect the puzzle piece to other pieces.

In some embodiments, the puzzle generator 204*b* receives, via the image sharing application 202*b*, a time limit specified by the image sharing user as a constraint on the image-receiving user. In one of these embodiments, when the puzzle generator 204*b* makes the puzzle assembly interface 220*b* available to a user, the puzzle generator 204*b* begins a countdown at the time limit specified. If the user has not completed assembling the puzzle piece images by the time the puzzle generator 204*b* completes the countdown, the puzzle generator 204*b* may block the user from continuing to use the puzzle assembly interface 220*b*. For example, the puzzle generator 204*b* may play a sound file or display an image file indicating the user has run out of time to assemble the puzzle pieces. As another example, the puzzle generator 204*b* may allow the user to restart the puzzle but may not allow the user to continue work on the existing attempt to assemble the puzzle piece images. As a further example, the puzzle generator 204*b* may allow the user to automatically re-try a failed puzzle a second time; if a time period specified by the sending user expires before completion of the puzzle by the receiving user, the puzzle generator 204*b* may reset the puzzle and the time-limit. The sending user may specify a number of times that the receiving user is authorized to try to complete the puzzle. As another example, the receiving user may need to send a request to the sending user, asking for authorization to try to complete the puzzle again. In some embodiments, the sending user may specify that the receiving user does not have authorization to view the shared image if they do not complete the puzzle.

In one embodiment, if the user has completed assembling the puzzle piece images before the puzzle generator 204*b* completes the countdown, the puzzle generator 204*b* may display the original image to the user. The puzzle generator 204*b* may also display a congratulatory image or play a congratulatory sound file. The puzzle generator 204*b* may also transmit a notification to the image-sharing user of the completion of the puzzle. In embodiments in which the puzzle generator 204*b* maintains a ranking of the user's best times compared to either the user's past performance or other users' performances (e.g. "leaderboards"), the puzzle generator 204*b* may determine whether to update the ranking based on the new time of completion. In other embodiments, the puzzle generator 204*b* may provide the user with an option to re-do the puzzle.

The method includes displaying, by the puzzle generator, the image associated with the plurality of puzzle piece images upon confirmation of assembly (328). Referring still to FIG. 3B, and in connection with FIG. 2P, in some embodiments, the puzzle generator 204*b* provides the user with the option of saving the image (e.g., to local storage). In another embodiment, the puzzle generator 204*b* provides the user with the option of sharing the image with yet another user. In still another embodiment, upon confirmation of assembly, the image sharing application 202*b* transmits, to the image sharing application 202*a*, an indication that the recipient user has assembled the plurality of puzzle piece images.

In some embodiments, the image sharing application 202*b* receives a time limit for displaying the image upon completion of the puzzle. In one of these embodiments, therefore, the puzzle generator 204*b* displays the image for the amount of time specified and then deletes the image from the computing device 102*b*. In another of these embodiments, the puzzle generator 204*b* also deletes the plurality of puzzle piece images.

Embodiments of the above-described system and method permit an image-sharing user to engage an image-receiving user in a participatory, interactive method for sharing and viewing images. Such receiver-based systems and methods may increase a level of engagement between users and enhance an image-receiving user's experience of viewing another user's images.

It should be understood that the systems described above may provide multiple ones of any or each of the described components and these components may be provided on either a standalone machine or, in some embodiments, on multiple machines in a distributed system. The phrases 'in one embodiment,' 'in another embodiment,' and the like, generally mean the particular feature, structure, step, or characteristic following the phrase is included in at least one embodiment of the present disclosure and may be included in more than one embodiment of the present disclosure. Such phrases may, but do not necessarily, refer to the same embodiment.

The systems and methods described above may be implemented as a method, apparatus, or article of manufacture using programming and/or engineering techniques to produce software, firmware, hardware, or any combination thereof. The techniques described above may be implemented in one or more computer programs executing on a programmable computer including a processor, a storage medium readable by the processor (including, for example, volatile and non-volatile memory and/or storage elements), at least one input device, and at least one output device. Program code may be applied to input entered using the input device to perform the functions described and to generate output. The output may be provided to one or more output devices.

Each computer program within the scope of the claims below may be implemented in any programming language, such as assembly language, machine language, a high-level procedural programming language, or an object-oriented programming language. The programming language may, for example, be LISP, PROLOG, PERL, C, C++, C#, JAVA, or any compiled or interpreted programming language.

Each such computer program may be implemented in a computer program product tangibly embodied in a machine-readable storage device for execution by a computer processor. Method steps of the invention may be performed by a computer processor executing a program tangibly embodied on a computer-readable medium to perform functions of the invention by operating on input and generating output. Suitable processors include, by way of example, both general and special purpose microprocessors. Generally, the processor receives instructions and data from a read-only memory and/or a random access memory. Storage devices suitable for tangibly embodying computer program instructions include, for example, all forms of computer-readable devices; firmware; programmable logic; hardware (e.g., integrated circuit chip, electronic devices, a computer-readable non-volatile storage unit, non-volatile memory, such as semiconductor memory devices, including EPROM, EEPROM, and flash memory devices); magnetic disks such as internal hard disks and removable disks; magneto-optical disks; and CD-ROMs. Any of the foregoing may be supplemented by, or incorporated in, specially-designed ASICs (application-specific integrated circuits) or FPGAs (Field-Programmable Gate Arrays). A computer can generally also receive programs and data from a storage medium such as an internal disk (not shown) or a removable disk. These elements will also be found in a conventional desktop or workstation computer as well as other computers suitable for executing computer programs implementing the methods described herein, which may be used in conjunction with any digital print engine or marking engine, display monitor, or other raster output device capable of producing color or gray scale pixels on paper, film, display screen, or other output medium. A computer may also receive programs and data from a second computer providing access to the programs via a network transmission line, wireless transmission media, signals propagating through space, radio waves, infrared signals, etc.

Having described certain embodiments of methods and systems for interactive image sharing, it will now become apparent to one of skill in the art that other embodiments incorporating the concepts of the disclosure may be used. Therefore, the disclosure should not be limited to certain embodiments, but rather should be limited only by the spirit and scope of the following claims.

What is claimed is:

1. A method for interacting with a shared image, the method comprising:

receiving, by an image sharing application executing on a first client computing device, from a second client computing device, a plurality of puzzle piece images and an image associated with the plurality of puzzle piece images;

generating, by a puzzle generator executing on the first client computing device, a puzzle assembly interface on the first client computing device within which to display the plurality of puzzle piece images;

displaying, by an image sharing application executing on the first client computing device, in a group challenge interface, data associated with a plurality of client computing devices having received the plurality of puzzle piece images and the image associated with the plurality of puzzle piece images, the displayed data including a time period set by the second client computing device for assembly of the plurality of puzzle piece images;

receiving, by the puzzle assembly interface, from a user of the first client computing device, an instruction to modify an orientation of display of one of the plurality of puzzle piece images;

displaying, by the puzzle assembly interface, a modified version of the one of the plurality of puzzle piece images;

confirming, by the puzzle generator, assembly of the plurality of puzzle piece images by a user of the first computing device;

tracking, by the puzzle assembly interface, an amount of time taken by the user of the first client computing device to complete assembly of the plurality of puzzle piece images;

transmitting, by the puzzle assembly interface, the tracked amount of time, to the second client computing device;

displaying, by the puzzle generator, the image associated with the plurality of puzzle piece images upon confirmation of assembly;

receiving, by the first client computing device, from the second client computing device, a listing of (i) an identifier of each of the plurality of client computing devices having received the plurality of puzzle piece images and the image associated with the plurality of puzzle piece images, and (ii) an identification of the amount of time the users of each of the plurality of client computing devices needed to assemble the plurality of puzzle piece images; and modifying, by the image sharing application, the group challenge interface to display the received amount of time taken to complete assembly of the plurality of puzzle piece images by each of the plurality of client computing devices having received the plurality of puzzle piece images and the image associated with the plurality of puzzle piece images.

2. The method of claim 1, wherein receiving further comprises receiving an identification of a user of the second client computing device, the user of the second client computing device having initiated transmission of the image to the image sharing application.

3. The method of claim 2 further comprising transmitting, by the first client computing device, to the second client computing device, upon confirmation of assembly, an indication of completion of assembly of the plurality of puzzle piece images.

4. The method of claim 1, wherein receiving further comprises receiving a puzzle template associated with the plurality of puzzle piece images.

5. The method of claim 4, wherein generating further comprises generating a user interface for assembling the plurality of puzzle piece images, based on the puzzle template.

6. The method of claim 4, wherein receiving further comprises receiving an identification of a location within the puzzle template, the location associated with one of the plurality of puzzle pieces.

7. The method of claim 4, wherein confirming further comprises confirming that the puzzle generator has received an instruction to display each of the plurality of puzzle piece images in a location within the puzzle assembly interface that is substantially the same as a location within the puzzle template.

8. The method of claim 1, wherein generating further comprises generating a display of at least one of the plurality of puzzle piece images.

9. The method of claim 1, wherein generating further comprises generating a user interface within the puzzle assembly interface with which the user may select at least one of the plurality of puzzle piece images and indicate a location in the puzzle assembly interface in which to display the at least one of the plurality of puzzle piece images.

10. A system for interacting with a shared image, the system comprising:

an image sharing application (i) executing on a first client computing device, (ii) receiving, from a second client computing device, a plurality of puzzle piece images and an original image associated with the plurality of puzzle piece images, (iii) displaying, in a group challenge interface, data associated with a plurality of client computing devices having received the plurality of puzzle piece images and the image associated with the plurality of puzzle piece images, the displayed data including a time period set by the second client computing device for assembly of the plurality of puzzle piece images; and a puzzle generator (i) executing on the first client computing device, (ii) generating a puzzle assembly interface on the first client computing device within which to display the received plurality of puzzle piece images, (iii) receiving, by the puzzle assembly interface, from a user of the first client computing device, an instruction to modify an orientation of display of one of the plurality of puzzle piece images, (iv) displaying, by the puzzle assembly interface, a modified version of the one of the plurality of puzzle piece images, (v) confirming assembly of the plurality of puzzle piece images by a user of the first computing device, (vi) displaying the original image associated with the plurality of puzzle piece images upon confirmation of assembly, (vii) tracking an amount of time taken by the user of the first client computing device to complete assembly of the plurality of puzzle piece images, (viii) transmitting, to the second client computing device, the tracked amount of time;

wherein the image sharing application further comprises functionality for receiving, from the second client computing device, a listing of an identifier of each of the plurality of client computing devices having received the plurality of puzzle piece images and the image associated with the plurality of puzzle piece images, and an identification of the amount of time the users of each of the plurality of client computing devices needed to assemble the plurality of puzzle piece images, and wherein the image sharing application further comprises functionality for modifying the group challenge interface to display the received amount of time taken to complete assembly of the plurality of puzzle piece images by each of the plurality of client computing devices having received the plurality of puzzle piece images and the image associated with the plurality of puzzle piece images.

* * * * *